United States Patent [19]

Kirkland

[11] 4,262,748

[45] Apr. 21, 1981

[54] REMOTE MULTIPLE STRING WELL COMPLETION

[75] Inventor: Kerry G. Kirkland, Houston, Tex.

[73] Assignee: Armco Inc., Middletown, Ohio

[21] Appl. No.: 67,733

[22] Filed: Aug. 20, 1979

[51] Int. Cl.[3] ..... E21B 23/00; E21B 33/035

[52] U.S. Cl. ..... 166/348; 166/75 A; 166/85; 166/313; 166/341; 285/25; 285/39; 285/137 A; 285/140

[58] Field of Search ..... 166/348, 341, 313, 315, 166/75 A, 85, 89, 237; 285/24, 25, 39, 137 A, 140

[56] References Cited

U.S. PATENT DOCUMENTS

| | | | |
|---|---|---|---|
| 3,268,239 | 8/1966 | Castor et al. | 166/237 X |
| 3,603,401 | 9/1971 | Nelson | 166/89 X |
| 3,661,206 | 5/1972 | Putch et al. | 166/89 X |
| 3,688,841 | 9/1972 | Baugh | 166/89 X |
| 3,693,714 | 9/1972 | Baugh | 166/348 |
| 3,741,294 | 6/1973 | Morrill | 166/89 X |
| 3,800,869 | 4/1974 | Herd et al. | 166/337 |
| 3,807,497 | 4/1974 | Baugh | 166/87 X |
| 3,834,460 | 9/1974 | Brun et al. | 166/341 |
| 3,847,215 | 11/1974 | Herd | 166/337 |
| 3,971,576 | 7/1976 | Herd et al. | 166/348 X |

*Primary Examiner*—Stephen J. Novosad

*Attorney, Agent, or Firm*—Roylance, Abrams, Berdo & Farley

[57] ABSTRACT

Method and apparatus for multiple string well completions by remote operations in underwater installations, by which the tubing strings are installed independently rather than simultaneously.

16 Claims, 20 Drawing Figures

REMOTE MULTIPLE STRING WELL COMPLETION

RELATED APPLICATION

Apparatus disclosed in this application is also disclosed and claimed in my copending application Ser. No. 067,745, filed concurrently herewith.

BACKGROUND OF THE INVENTION

When multiple string wells are installed on land, it is relatively simple to provide the option of running the tubing strings either simultaneously or individually, with so-called split tubing hangers being employed when the strings are run individually. For underwater installations, the tendency in the art has been to run the tubing strings simultaneously because of difficulties encountered in remote installation of split hangers. However, running multiple tubing strings simultaneously into a subsea or other underwater well installation requires expensive equipment on the platform or vessel which constitutes the operational base for handling the multiple strings and also presents severe problems in providing blowout preventers which will accommodate two or more tubes without crushing them. Accordingly, much effort has been expended in devising improved equipment for multiple string underwater wells, as seen for example in the following U.S. Pat. Nos.

3,603,401—Nelson et al
3,661,206—Putch et al
3,688,841—Baugh
3,693,714—Baugh
3,741,294—Morrill
3,800,869—Herd et al
3,807,497—Baugh
3,847,215—Herd Despite extensive prior art effort and considerable success in the field, there has been a continuing need for improved methods and apparatus by which the tubing strings can be run individually into an underwater well, with simple and positive remote orientation of the split hangers, the capability of readily retrieving the hangers individually, fully independent running and retrieval of the tubing strings, improved sealing of the tubing hanger body, improved blowout protection and maximum running clearance at the wellhead for such things as gas lift valves.

OBJECTS OF THE INVENTION

A general object of the invention is to provide a method and apparatus by which multiple tubing strings can be run into an underwater well installation independently rather than simultaneously.

Another object is to provide such a method and apparatus in which a multiple string hanger body is landed independently in oriented position and the tubing strings are then installed independently using the same orienting means employed to orient the hanger body.

A further object is to provide for improved sealing of the hanger body in the wellhead.

Yet another object is to provide such a method and apparatus which depends only upon relatively simple mechanical devices for all of the operations involved.

SUMMARY OF THE INVENTION

According to the invention, a multiple string tubing hanger body or bushing is secured to a handling tool, with a known orientation of the body on the tool, the tool is then manipulated by a handling string to land the hanger body in a wellhead body, and the combination of the tool and the hanger body is then rotated relative to the wellhead body until a locator key on the tool snaps into a locator groove on the wellhead body so that the hanger body has a known rotational orientation in the wellhead. By combined rotation of the handling tool relative to the hanger body and downward movement of the tool relative to the hanger body, a packer is then set mechanically to seal between the hanger body and the wellhead body, and latch members are actuated, by the same motion used to set the packer, to latch the hanger body in place. At this stage, after the handling tool has been removed, the hanger body can be retrieved by a simple retrieval operation, if required. The first tubing string and its individual hanger segment are then installed by use of a tool which allows orientation of the hanger segment to be accomplished using the same locator groove in the wellhead body which was employed to orient the hanger body or bushing. During orientation of the tubing string and its hanger segment, the hanger segment is retained in an elevated position, above its intended landed position, the hanger segment being released for landing only after orientation has occurred. Landing of the hanger segment automatically releases the handling tool from the segment so the tool and handling string can be retrieved. Using the same handling tool employed to install the first tubing string, a deflector plug is now installed in the hanger segment of that string, and the handling tool is again retrieved. Still using the same tool, the second tubing string and its hanger segment are installed, with orientation again occurring before the segment is landed. Using the same handling tool but with a different main body substituted therein, a tubing hanger packoff unit is now installed, with orientation of the packoff unit being achieved before that unit is landed. If necessary, the packoff unit can be retrieved at this stage, using a simple tool which does not require orientation. A circulation tool is now installed, again using the same handling tool but with another main body substituted therein. Again, orientation of the circulation tool is first accomplished and the circulation tool is then released and landed. The wellhead upper body is then removed and the Christmas tree installed conventionally, using the guide posts of the permanent guide base for orientation.

IDENTIFICATION OF THE DRAWINGS

In order that the manner in which the foregoing and other objects are achieved according to the invention can be understood in detail, one particularly advantageous apparatus embodiment of the invention, and the method as practiced therewith, will be described with reference to the accompanying drawings, which form part of the original disclosure of this application, and wherein:

FIG. 1 is a vertical axial cross-sectional view showing installation of a multiple string tubing hanger body in an upper wellhead body of an underwater installation;

FIGS. 2 and 3 are transverse cross-sectional views taken generally on lines 2—2 and 3—3, FIG. 1;

DETAILED DESCRIPTION OF APPARATUS

Figure 1:
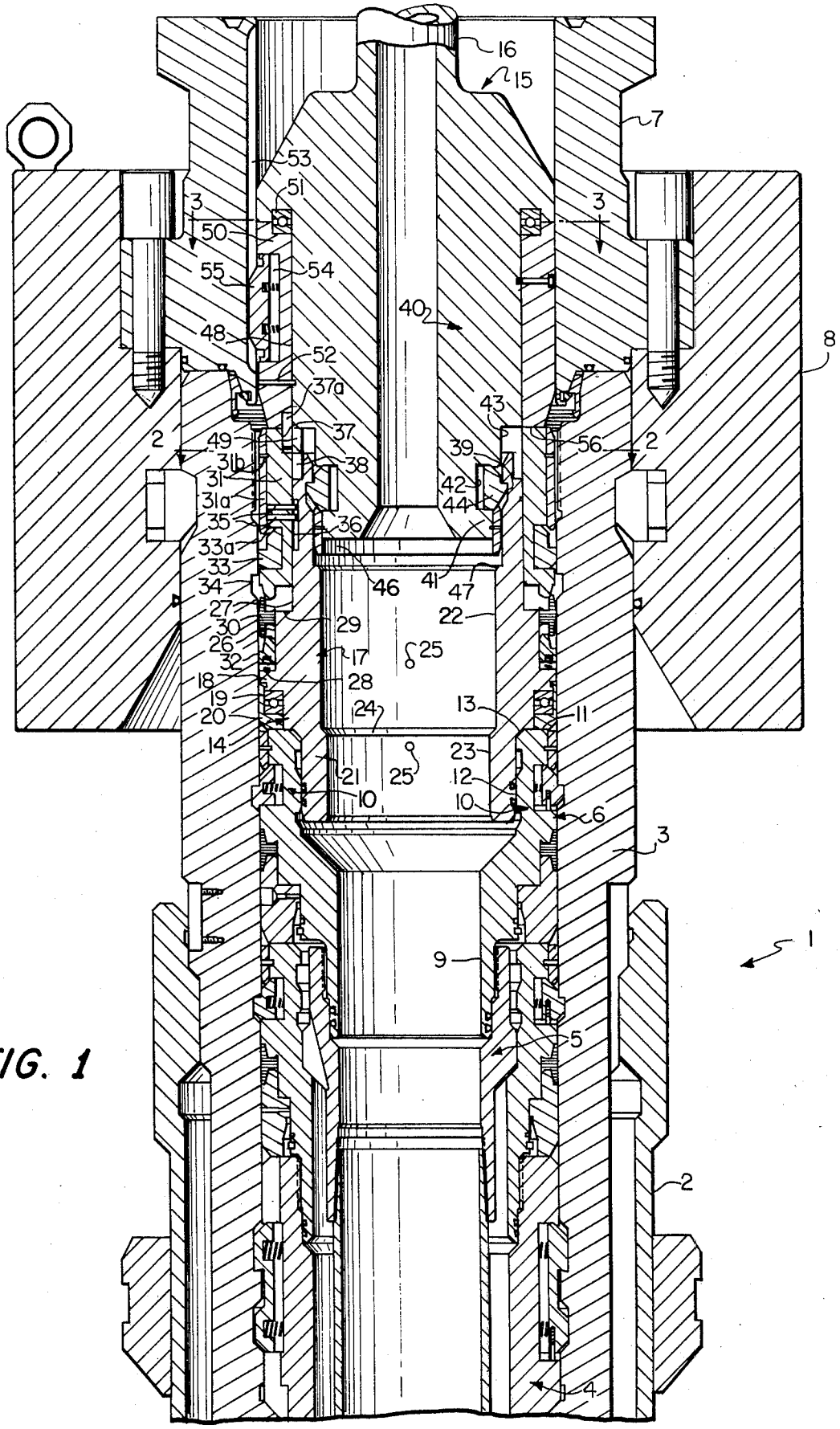
Figure 2:
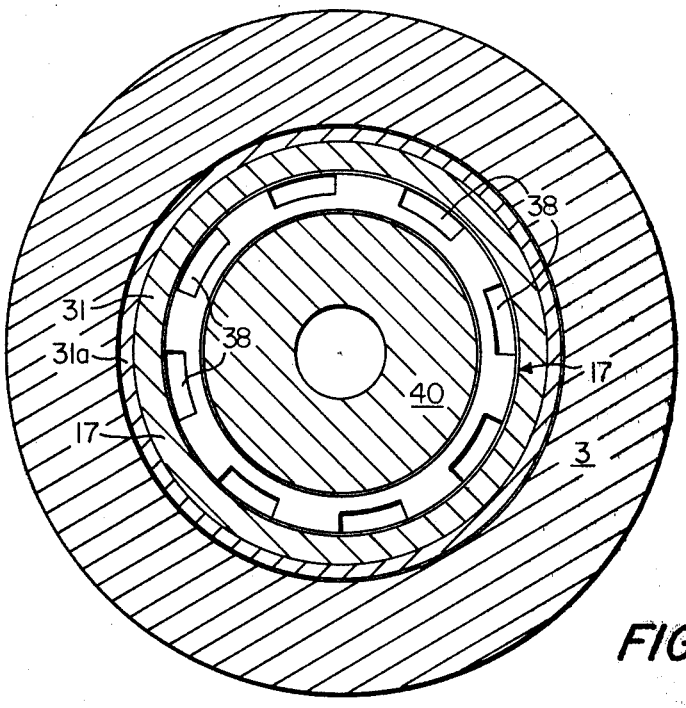

In order that the method can be readily understood, one apparatus embodiment of the invention will first be described for each stage of the complete method.

Hanger Body, Packer And Handling Tool

Referring first to FIGS. 1–4, the invention is illustrated as applied to remote installation of two tubing strings in a well including an underwater wellhead indicated generally at 1 comprising surface casing 2, a wellhead body 3 installed in the surface casing, casing hangers 4 and 5 supported in body 3 and each supporting a string of casing, a mandrel packing unit 6, a wellhead upper body 7, and a remotely operated connector 8 securing upper body 7 to the top of body 3. Connector 8 can be of any suitable conventional type, such as that shown in U.S. Pat. No. 3,228,715 to Neilon et al. Body 7 is equipped with guide arms (not shown) to cooperate with the guide posts of the usual primary guide system (not shown) so that, when landed and secured by connector 8 to body 3, body 7 is in a known rotational position relative to the guide posts. Packing unit 6 has a main body including a lower portion 9, having an inner diameter equal to that of the string of casing suspended from hanger 5, and an upper portion 10 which is of substantially larger internal diameter. Upper portion 10 presents a flat transverse annular upper end face 11, a right cylindrical inner surface 12, and a downwardly and inwardly tapering frusto-conical shoulder 13 which joins face 11 and surface 12.

Preparatory to installation of the tubing strings, a tubing hanger body or bushing 14 is installed by use of a handling tool 15 manipulated by the usual handing string 16. Hanger body 14 comprises a tubular main body 17 having an intermediate portion 18 of outer diameter such as to fill the bore of wellhead body 3. Below portion 18, the outer diameter of body 17 is reduced to accommodate an antifriction thrust bearing 19, which can be a conventional ball bearing or roller bearing disposed between a spacer ring 20 and the downwardly facing shoulder presented by intermediate portion 18. Lower end portion 21 of body 17 is of further reduced outer diameter so as to be slidably received by the inner wall 12 of the upper portion of casing hanger 6. When hanger body 14 is fully landed, it is supported via bearing 19 on the upper end face 11 of casing hanger 6.

The bore of body 17 is cylindrical, including an upper portion 22 of larger diameter, a lower portion 23 of smaller diameter, and an intermediate transverse annular upwardly facing shoulder 24. Two vertically aligned orienting pins 25 project radially inwardly from the wall of the bore of body 17, one above and one below shoulder 24, for a purpose later described.

Above intermediate portion 18, body 17 has a first portion 26 of reduced outer diameter and, thereabove, a second portion 27 of still smaller outer diameter so that a first transverse annular upwardly facing shoulder 28 is provided between portions 18 and 26, and a second such shoulder 29 is provided between portions 26 and 27. Portions 26 and 27 accommodate a seal unit comprising an elastomeric packing ring 30, disposed between an actuator sleeve 31 and a compression ring 32, ring 32 being adjacent shoulder 28 and sleeve 31 slidably embracing portion 27 of body 17. Sleeve 31 has an outwardly opening transverse groove which accommodates latch segments 33, the segments being spring biased outwardly for engagement in a transverse annular inwardly opening groove 34 in wellhead body 3. Segments 33 have upwardly and inwardly slanting camming surfaces 33*a* which are exposed upwardly when the segments are engaged in groove 34. An actuator sleeve 31*a* slidably embraces sleeve 31 above segments 33 and is initially fixed to sleeve 31 by shear pins at 31*b*.

Sleeve 31 is provided with two orienting pins 35 which project radially inwardly from the sleeve into slidable engagement in a vertical external slot 36 in the upper end portion of body 17. A key slot 37 opens upwardly at the upper end of sleeve 31. Thus, if the rotational position of key slot 37 is predetermined, the rotational location of orienting pins 25 will likewise be predetermined. The upper end of body 17 is provided with a circumferentially spaced series of upwardly opening notches 38.

Hanger body 14 is mounted on handling tool 15 before running the combination of the tool and hanger body. The upper end portion of body 17 is provided with a transverse annular inwardly opening groove 39. Tool 15 includes a main body 40 having a lower end portion 41 of smaller outer diameter, a transverse annular outwardly opening groove 42 at the upper end of portion 41, and a portion 43 located immediately above groove 42 and having an outer diameter such as to be slidably embraced by the inner surface of the portion of body 17 above groove 39. A plurality of latch segments 44 are disposed in groove 42 and urged outwardly by springs (not shown), segments 44 having lower camming faces 45 which slant downwardly and inwardly. Secured to body 40 by shear pins, an actuating ring 46 slidably embraces lower end portion 41 of body 40 and projects therebelow. Ring 46 is in turn slidably embraced by the upper end portion of body 17 which is of slightly enlarged inner diameter so as to present a transverse annular upwardly directed shoulder 47 against which ring 46 can be driven, as later described, to retract segments 44.

Above portion 43, body 40 has a larger diameter portion 48, and at the juncture between portions 48 and 43, portion 48 is provided with a plurality of downwardly projecting circumferentially spaced lugs 49 dimensioned and shaped to be accommodated respectively by notches 38 on body 17. Notches 38 are rectangular, mutually identical and equally spaced. Lugs 49 are likewise rectangular and equally spaced. When hanger body 14 is mounted on handling tool 15, the rotational position of body 17 relative to body 40 is such that lugs 49 are aligned with the spaces between notches 38, the lower edges of the lugs thus engaging portions of the upper end face of body 17.

The outer right cylindrical surface of portion 48 of body 40 is slidably embraced by a sleeve 50 having an outer diameter such as to be slidably embraced by the wall of the bore of wellhead upper body 7. The upper end portion of body 40 is enlarged to project outwardly over the upper end of sleeve 50, and an antifriction thrust bearing 51, such as a ball bearing or a roller bearing, is interposed between the upper end of the sleeve and the enlarged upper end portion of body 40. Sleeve 50 is initially fixed releasably to body 40, as by shear pins 52.

Figure 3:
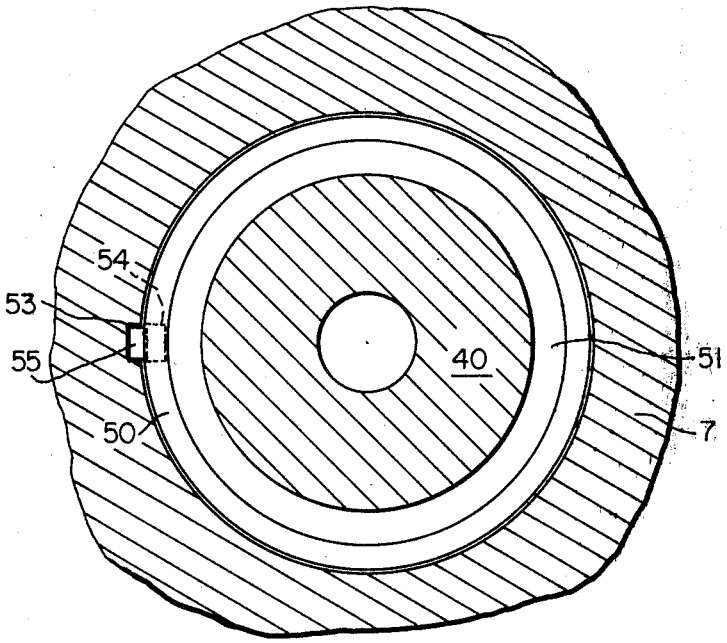
Figure 4:
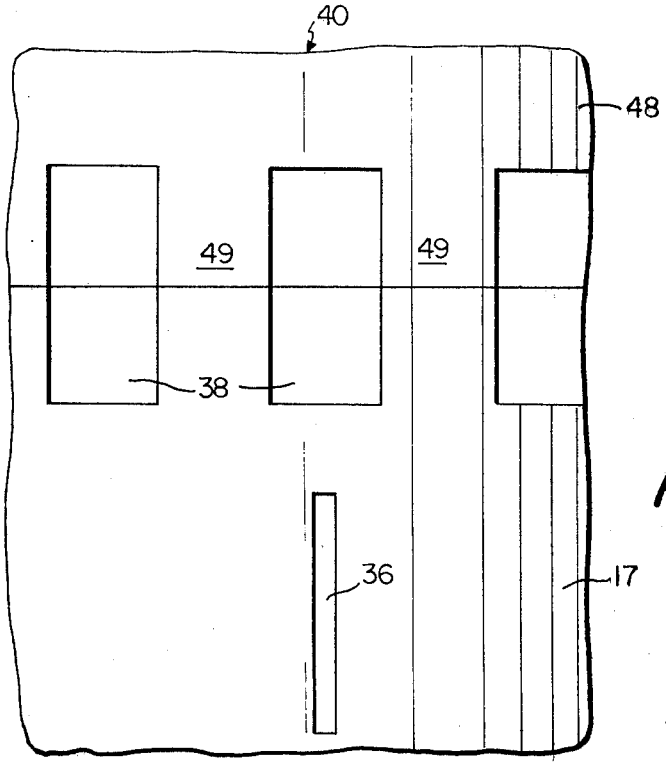
FIG. 4 is a fragmentary side elevational view of a portion of the apparatus of FIG. 1.
Figure 12:
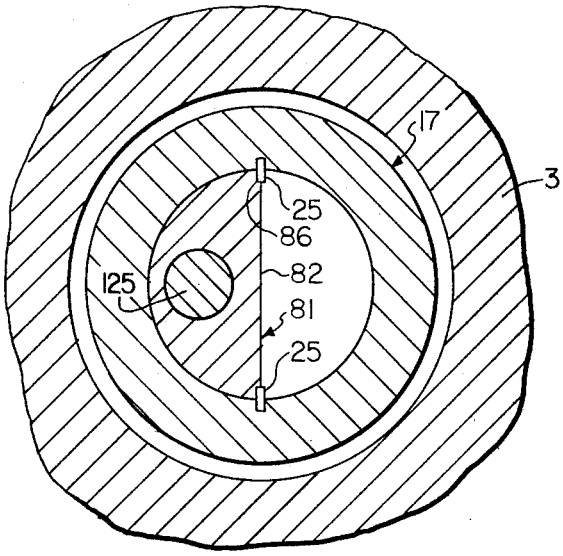
FIG. 12 is a horizontal sectional view taken generally on line 12—12, FIG. 11, after removal of the handling tool.

Wallhead upper body 7 is provided with a vertical inwardly opening locator groove 53, FIGS. 1 and 3, and, since body 7 is landed conventionally in a known position relative to the guide posts of the usual permanent guide base (not shown), the orientation of groove 53 is predetermined with reference to the permanent guide base. Sleeve 50 has a vertical outwardly opening slot 54 which accommodates a locator key 55 urged outwardly by springs as shown. Lower end face 56 of sleeve 50 is dimensioned for flush engagement with the upper end face of sleeve 31 and is provided with a downwardly projecting key 37*a*, FIG. 1, which cooperates with the upwardly opening locator slot 37 of sleeve 31.

When the combination of hanger body 14 and handling tool 15 is run in, spacer ring 20 of bearing 19 lands on upper end face 11 of mandrel packing unit 6, allowing the combination of hanger body 14 and tool 15 to be rotated, by manipulation of handling string 16, until locator key 55 on sleeve 50 snaps into locator groove 53 in wellhead upper body 7. Since sleeve 50 is rotationally fixed on sleeve 31 by key 37, and sleeve 31 is in turn rotationally fixed on body 17 of the hanger by pins 35, engagement of key 55 in groove 53 establishes a given rotational orientation of the orienting pins 25 of the hanger body with reference to wellhead upper body 7.

Figure 5:
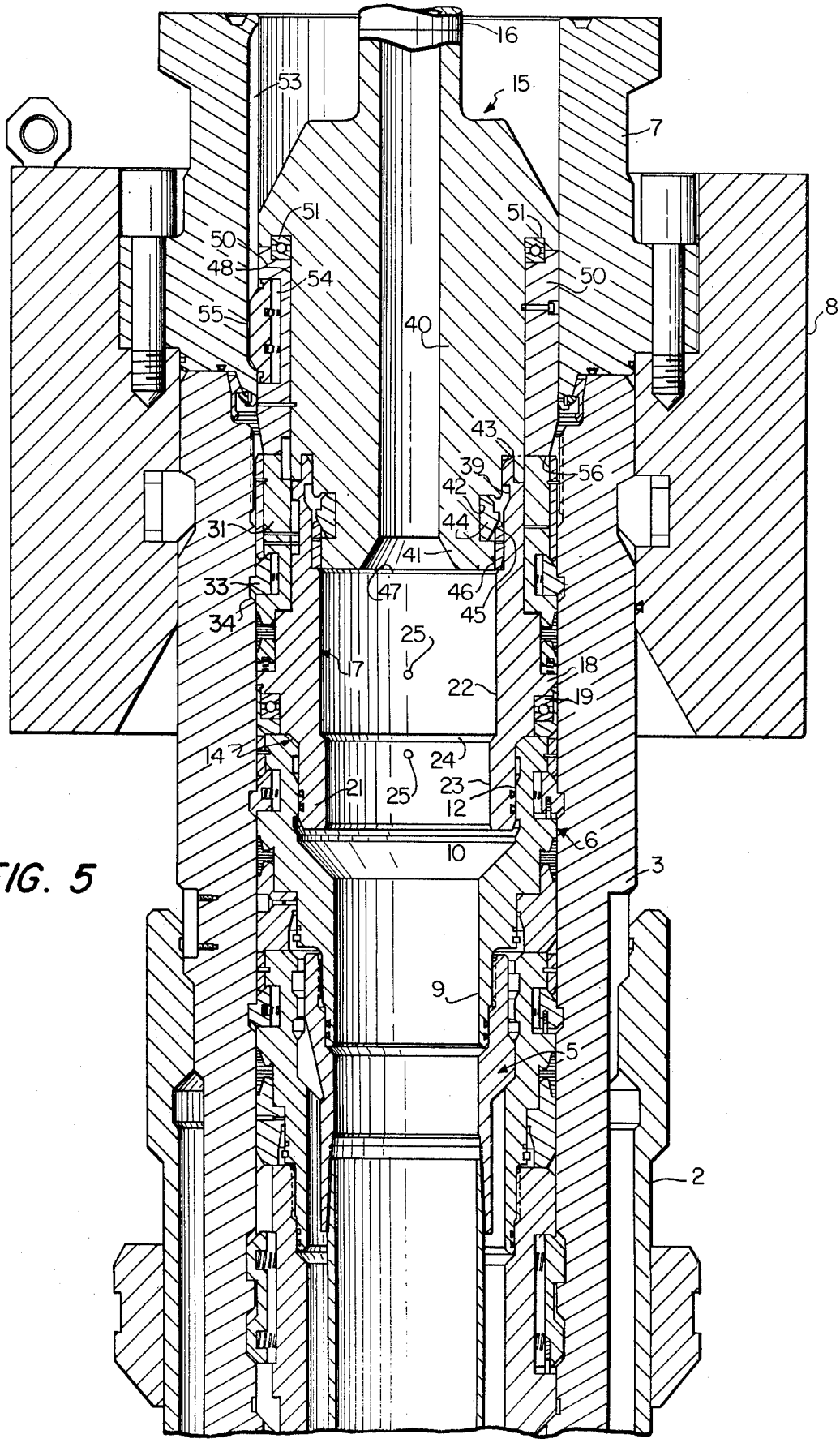
FIG. 5 is a view similar to FIG. 1 but with the packer between the hanger body and the wellhead body energized.

With key 55 engaged in groove 53, further rotation of the handling string shears the pins 52, freeing tool body 40 for rotation relative to the combination of sleeve 50 and hanger body 14. The handling string is now rotated until lugs 49 are aligned with notches 38 so that body 40 and its sleeve 50 are allowed to descend a distance equal to the depth of notches 38, bringing the elements to the condition seen in FIG. 5. Such downward movement causes sleeve 31 to move downwardly relative to body 17 so that, with ring 32 engaging shoulder 28, packing ring 30 is compressed between ring 32 and sleeve 31 and is forced into good sealing engagement with the wall of the bore of wellhead body 3 as well as with the lower end of sleeve 31 and with ring 32. Such downward movement of sleeve 50 also drives sleeve 31 downwardly far enough to bring segments 33 into alignment with groove 34, so that the segments snap outwardly into the groove to secure sleeve 31 in the packing-energizing position seen in FIG. 5. Simultaneously with energization of the packing, descent of tool body 40 relative to hanger body 14 causes sleeve 46 to engage shoulder 47 so that completion of the downward movement of the tool body causes camming surfaces 45 of latch segments 44 to ride over the upper end of sleeve 46, with the segments thus being retracted into groove 42. Sleeve 46 remains in its segment-retracting position by reason of frictional engagement with tool body portion 41 and the tool is thus free to be removed by the handling string, leaving hanger body 14 latched to wellhead body 3.

Hanger Body Retrieving Tool

Figure 6:
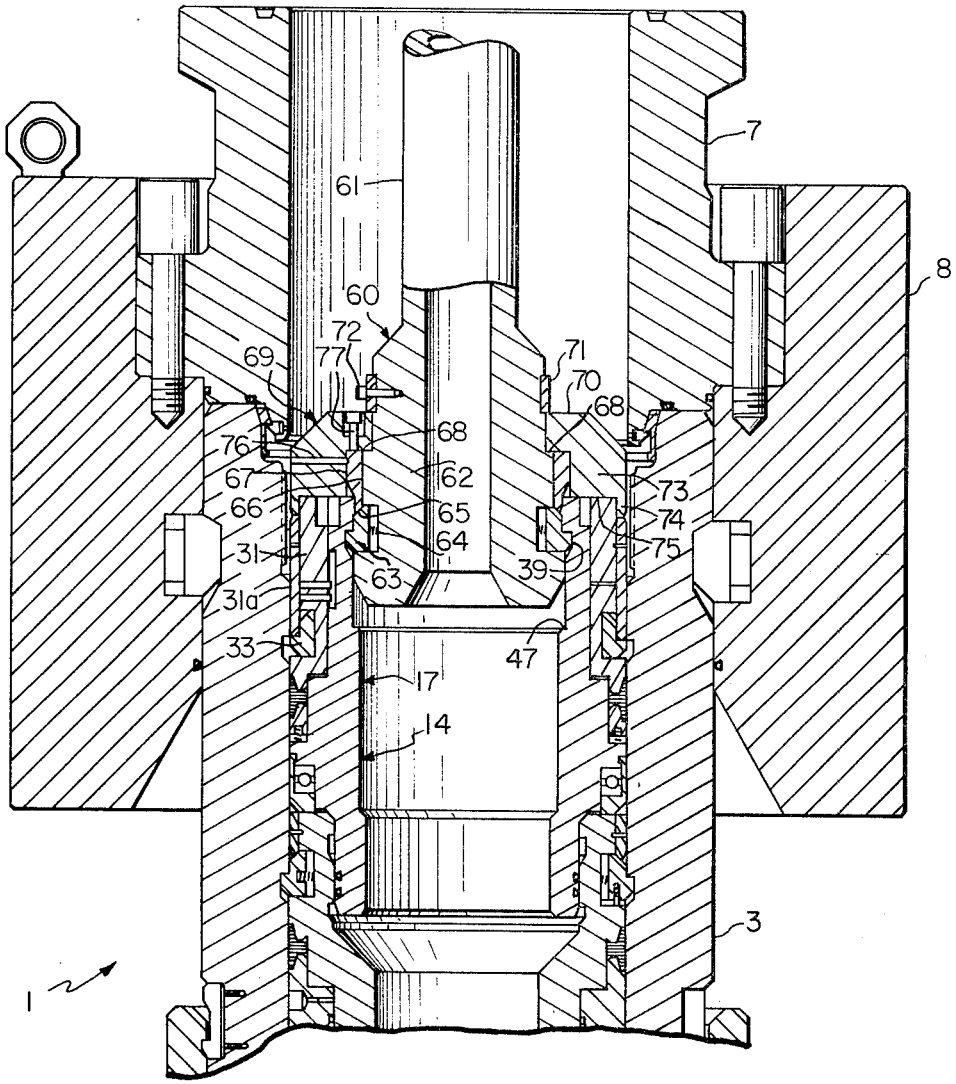
FIG. 6 is a vertical sectional view of a portion of the apparatus of FIGS. 1–5 illustrating the manner in which the hanger body can be retrieved.

Should retrieval of hanger body 14 be necessary, retrieval is accomplished in the manner shown in FIG. 6, employing a retrieving tool 60 manipulated by handling string 61. Tool 60 comprises a body 62 the lower end portion of which has an outer diameter such as to be slidably embraced by the wall of the bore of body 17 above shoulder 47. Body 62 has a transverse annular outwardly opening groove accommodating a plurality of latching segments 63 urged outwardly by springs 64 and having upwardly directed downwardly and outwardly slanting camming surfaces 65. Above the groove for segments 63, body 62 presents a right cylindrical outer surface 66 embraced by a segment-retracting sleeve 67. At the upper end of surface 66, the outer diameter of body 62 is reduced to provide a transverse annular upwardly directed shoulder 68.

Tool 60 further includes a generally cup-shaped member 69 having a transverse wall 70 with a central opening embracing body 62 above shoulder 68, wall 70 being clamped against shoulder 68 by a ring 71 secured in a suitable groove in body 62, as by screw 72. The annular wall of member 69 includes a radially thick portion 73, having an inner diameter such as to slidably embrace sleeve 67, and a lower end portion 74 which depends from the outer periphery of portion 73 and is identical to sleeve 31*a* in thickness and diameter so that, when the lower end portion of body 62 is inserted downwardly into the bore of body 17, the end face of portion 74 comes into engagement with the upper end face of sleeve 31*a*. Portion 73 presents a downwardly directed shoulder 75 and portion 74 projects beyond shoulder 75 by a distance such that, as tool 60 is fully landed to bring shoulder 75 into engagement with the upper end face of sleeve 31, portion 74 projects downwardly sufficiently to force sleeve 31*a* downwardly until segments 33 are fully retracted and hanger body 14 is therefor free for removal from the wellhead. Similarly, the lower portion of body 62 projects below shoulder 75 by a distance such that, when shoulder 75 engages the upper end of sleeve 31, segments 63 are aligned with and snap outwardly into groove 39 of body 17, thus securing handling tool 60 to hanger body 14. Upward withdrawal of the handling string then retrieves the hanger body and its associated seal devices.

Sleeve 67 is fixed to member 69 by shear pin 76 and does not come into play until retrieval of hanger body 14 has been accomplished. A plurality of screws 77 extend downwardly through threaded bores in transverse wall 70 of member 69 and are aligned with sleeve 67. When, during retrieval, tool 60 is raised to the platform or vessel at the surface above the well, screws 77 are operated manually to shear the pins 76 and force sleeve 67 downwardly until segments 63 are fully retracted, and the retrieved hanger body 14 can then be removed from tool 60.

Installation of Firsrt Tubing String

Figure 10:
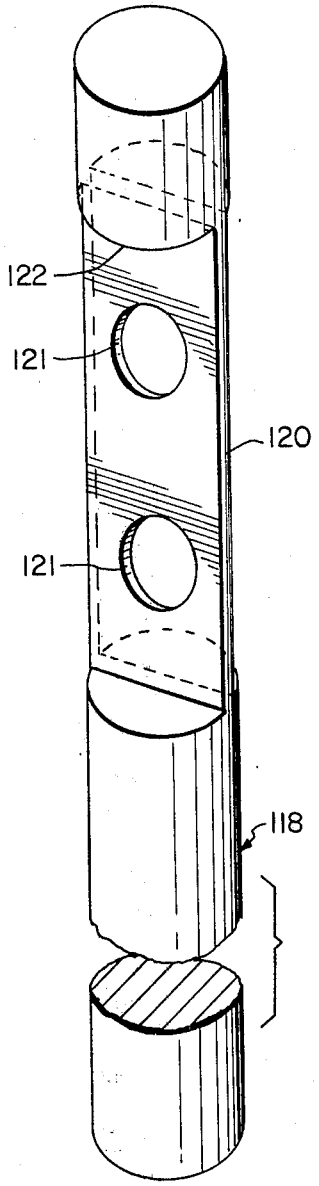
FIG. 10 is a fragmentary perspective view of a latch rod employed in the handling tool employed for accomplishing the installation illustrated in FIG. 7.
Figure 9:
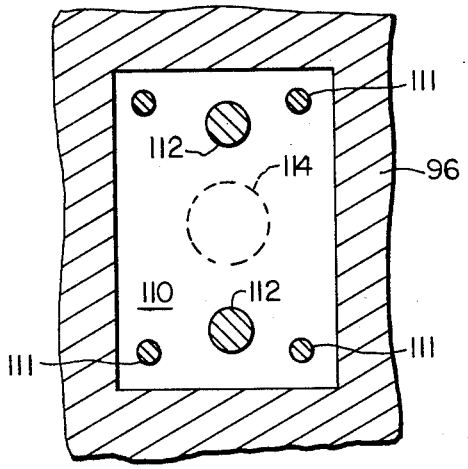
FIG. 9 is a vertical sectional view taken generally on line 9—9, FIG. 8.
Figure 11:
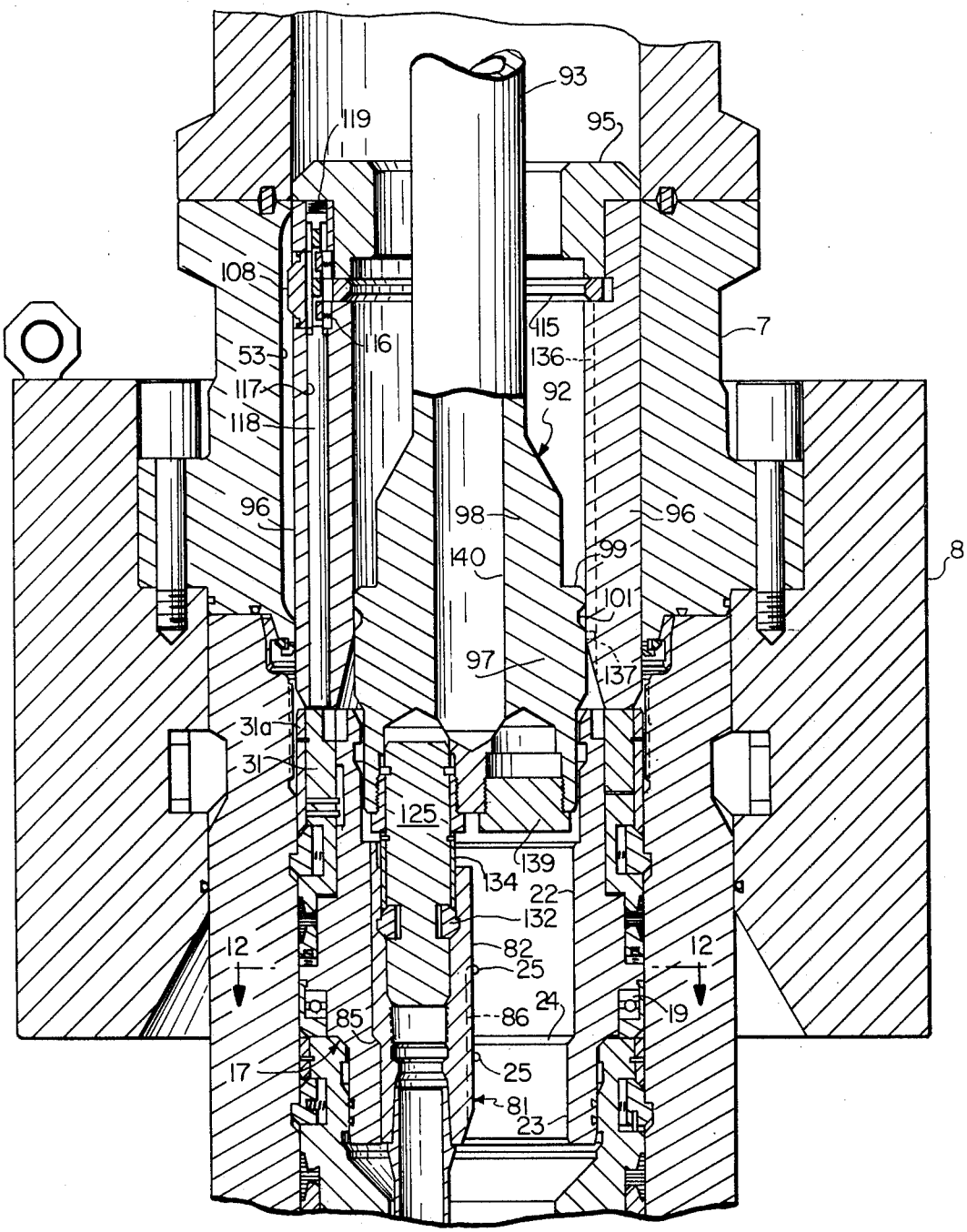
FIG. 11 is a view similar to FIG. 7 showing the tubing hanger segment and its handling tool after landing of the segment in the hanger body.

Referring now to FIGS. 7–11, it will be seen that the invention employs for the first-installed tubing string 80 a hanger segment 81 having a flat lateral outer surface portion 82, an upper semi-cylindrical outer surface portion 83 of larger diameter, and a lower semi-cylindrical outer surface portion 84 of smaller diameter, surface portions 83 and 84 being joined by a transverse arcuate downwardly directed shoulder 85. Hanger segment 81 is so dimensioned that shoulder 85 can seat on shoulder 24 of hanger body 14, as seen in FIG. 11, with surfaces 83 and 84 of the segment then being slidably embraced by wall portions 22 and 21, respectively, of the bore of hanger body 14. At each juncture between surface 82 and surface 83, the segment is provided with a straight elongated longitudinally extending groove 86 which opens through the bottom end of the segment and is long enough so that, when shoulder 85 is engaged with shoulder 24, each groove 86 will accommodate the corresponding pair of orienting pins 25.

Segment 81 has a longitudinal through bore, the lower end of which is threaded to accept the threaded end of the uppermost joint of tubing string 80. At an appropriate intermediate point, the through bore includes a transverse annular upwardly facing shoulder 87. Above shoulder 87, the through bore is defined by a wall portion 88, a transverse annular inwardly opening latch groove 89, and an upper wall portion 90. Upper end face 91 of segment 81 slants downwardly toward flat outer surface portion 82.

Hanger element 81 is secured to a handling tool 92 carried by a handling string 93. Tool 92 includes a main body 94, a transverse annular member 95 and an elongated cylindrical tubular body 96. Body 94 includes a portion 97 of larger outer diameter, an upper portion 98 of smaller diameter, and a transverse annular upwardly directed shoulder 99 joining portions 97 and 98. Member 95 is circular, has a cylindrical axial through bore of a diameter of loosely embrace portion 98 of body 94, and has an outer diameter such as to extend across the upper end face of tubular body 96, member 95 being secured to body 96, as by cap screws 100. Body 96 is provided with a transverse annular inwardly opening groove 101, FIGS. 7 and 8, of rectangular radial cross-section. Portion 97 of body 94 has an outwardly opening transverse annular groove 102 so located as to be aligned transverse with grooves 101 when shoulder 99 and member 95 are engaged. The upper and lower walls of groove 102 are frustoconical and converge inwardly. Body 96 includes an outwardly opening recess 103, FIG. 8, which is in the form of a vertically elongated rectangle as viewed in side elevation and which accommodates an orienting member 104 of rectangular configuration, the side, top and bottom walls of recess 103 being slidably engaged respectively with the side, top and bottom surfaces of member 104. Orienting member 104 comprises a main body 105 having a front face 106 and rear face 107. A vertically elongated key 108, formed integrally with body 105, projects from front face 106. A vertical groove 109, FIG. 8, extends completely through body 105 and opens through rear face 107, groove 109 being of rectangular transverse cross-section. Member 104 is completed by a plate 110 which is secured to rear face 107 of body 105, as by screws 111, FIG. 9, and which includes two cylindrical bosses 112 which are spaced apart vertically and which project from plate 110 into groove 109. At the center of the rear wall of recess 103, body 96 is provided with a radial bore 113 communicating between recess 103 and groove 101 and slidably accommodating a transfer member 114. Groove 101 accommodates a resilient metal split ring 115, FIGS. 7 and 8, the dimensions of which are such that, when the ring is relaxed and undistorted, the ring is totally housed in groove 101, no portion of the ring projecting inwardly from body 96. The inner portion of ring 115 has frusto-conical top and bottom walls conforming to the upper and lower walls for groove 102 in portion 97 of body 94. Member 104 is urged outwardly by compression springs 116, FIG. 8.

Figure 7:
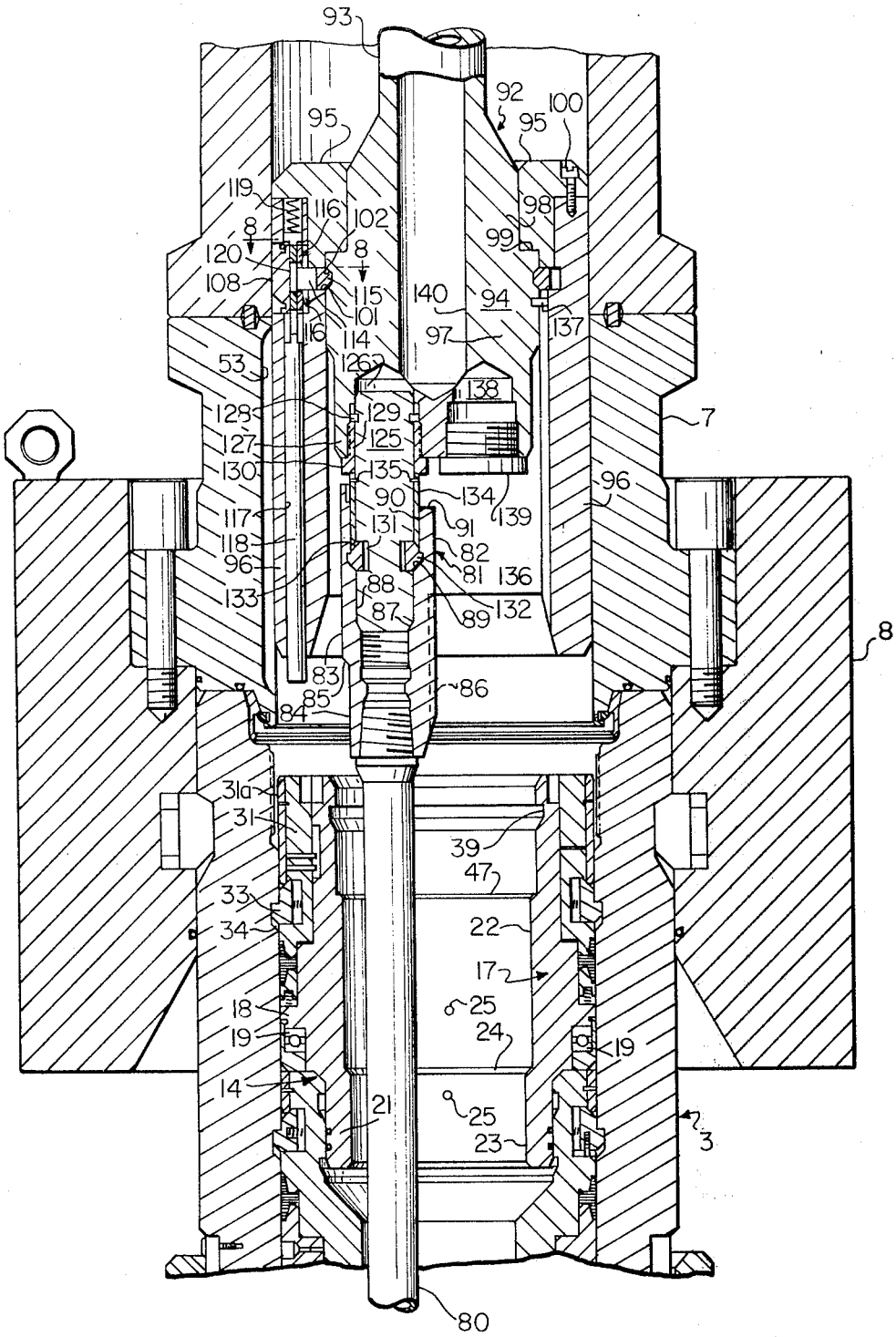
FIG. 7 is a view similar to FIG. 1 illustrating installation of a first tubing string and tubing hanger segment with the combination of the segment and its handling tool about to enter the wellhead upper body.

Body 96 has a vertical through bore 117, FIG. 7, of circular transverse cross-section, the through bore being centered on and therefore interrupted by recess 103. Slidably accommodated in bore 117 is a feeler rod 118 which serves to retain orienting member 104 in a retracted, inactive position until the lower end face of body 96 has been landed on the upper end face of ring 31. Bore 117 opens through the upper end of body 96 but is closed there by member 95. Rod 118 is slightly shorter than bore 117, and a helical compression spring 119 is disposed in the bore between the upper end of the feeler rod and member 95. Over a part of its length which is substantially longer than the height of recess 103, rod 118 is cut away to provide a flat relatively thin portion 120, FIGS. 8 and 10, having two circular ports 121 of a diameter adequate to freely accommodate bosses 112. Ports 121 are spaced apart vertically by the same distance as are bosses 112 and are so located on rod 118 as to register with the bosses only when the bottom end of the feeler rod is at the bottom end of body 96. Portion 120 of rod 118 is located in groove 109 in body 105 of member 104, the arrangement being such that, when bosses 112 are not engaged in ports 121, the feeler rod can move vertically relative to member 104 and, when the ports are registered with the bosses, member 104 can move laterally relative to the feeler rod.

Figure 8:
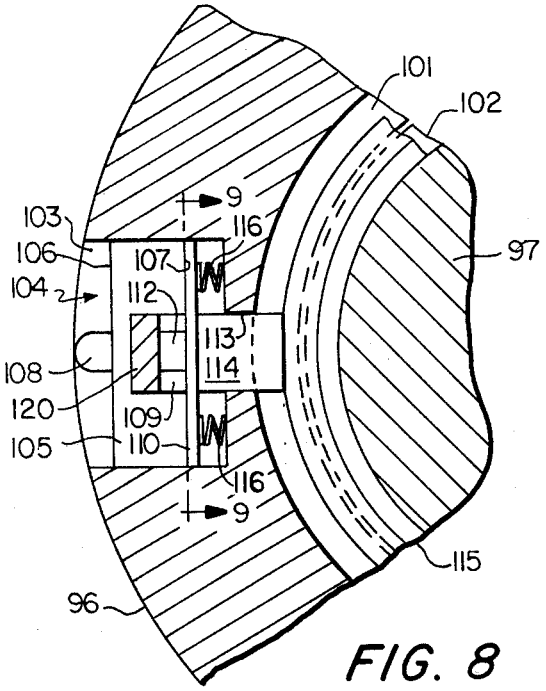
FIG. 8 is a fragmentary transverse sectional view taken generally on line 8—8, FIG. 7.

When the tool is assembled in the manner seen in FIG. 7, preparatory to its trip down to the wellhead, feeler rod 118 projects downwardly beyond the lower end of body 96, spring 119 biasing the rod so that shoulder 122, FIG. 10, engages the upper end of body 105. With the feeler rod in that position, ports 121 are out of registry with bosses 112, and member 104 occupies a position in which it is completely housed in recess 103. Thus, key 108 does not project beyond the circumference of body 96 and cannot engage any surrounding part during the trip down. The length of transfer member 114 is such that, with member 104 occupying its innermost or fully housed position, member 114 is forced radially inwardly to shift the split ring 115 to the right, as viewed in FIG. 7. Such shifting causes full engagement of the split ring in groove 102 of body 94 in the location of transfer member 114 and also causes the split ring to contract, so that the balance of the ring is also engaged in groove 102. Since the radial thickness of the split ring is substantially greater than the depth of groove 102, ring 115 is now engaged in both groove 102 and groove 101, as seen in FIGS. 7 and 8, and body 94 is therefore locked against axial movement relative to body 96.

Hanger segment 81 is releasably secured to body 94 of handling tool 92 by a dowel 125. The upper end portion of dowel 125 is received in a downwardly opening bore 126 in the lower end portion 127 of body 94 and includes a transverse annular groove in which a retaining ring 128 is secured, the ring projecting outwardly from the dowel and being slidably engaged in bore 126. The lower end of bore 126 is threaded to accommodate the tubular externally threaded shank of a thimble 129 which has a lower end flange 130. The outer surface of dowel 125 is right cylindrical and of a diameter to be slidably embraced by inner surface portion 88 of segment 81. The dowel is provided with a transverse annular outwardly opening groove 131 so located that, when the tip of the dowel is engaged with shoulder 87, groove 131 is aligned with groove 89. A plurality of latch segments 132 are slidably disposed in groove 131, are urged outwardly by compression springs (not shown), the latch segments being in accordance with U.S. Pat. No. 3,171,674 to Bickel et al and including downwardly and outwardly slanting upwardly directed camming surfaces 133. Inner surface portion 90 of segment 81 is of larger diameter than is surface portion 88, so that an annular space is provided between surface portion 90 and dowel 125 above groove 131, the latch camming surfaces 133 extending across the annular space when latch segments 132 are engaged in groove 89. In this space, an actuator sleeve 134 slidably enbraces dowel 125, the upper end of sleeve 134 engaging flange 130 of thimble 129, the sleeve being initially fixed to the dowel by shear pins 135.

The locations of shoulder 87, groove 89 and groove 131 and the length of dowel 125 and segment 81 are such that, when the tip of the dowel engages shoulder 87 so that latch segments 132 are engaged in groove 89, sleeve 134 engages both flange 130 and latch segment camming surfaces 133. Since sleeve 134 is fixed in place by shear pins 135, thimble 129 is clamped between sleeve 134 and retaining ring 128. Bore 126 in portion 127 of the tool body extends for a significant distance above ring 128 when the parts are in the positions just described.

Tubular body 96 is provided with a vertical inwardly opening groove 136 which extends for the full length of the inner wall of body 96 and is located diametrically across body 96 from key 108. Portion 97 of body 94 of the handling tool carries a pin 137 which projects radially from portion 97 in a location immediately below groove 102. Lower end portion 127 of body 94 has a second downwardly opening bore 138 which is identical to bore 126, the two bores 126 and 138 being spaced apart diametrically of body 94 so as to be equidistant from the longitudinal axis of body 94. The longitudinal axes of bores 126, 138 and the center of pin 137 lie in a common plane which contains the longitudinal axis of body 94. While tool 92 is being used to land segment 81, bore 138 is closed by a threaded plug 139. Body 94 of the handling tool has a central bore 140 which opens through the upper end of the body, so as to communicate with the interior of handling string 93, and at its lower end comjunicates with both bores 126 and 138.

Figure 7A:
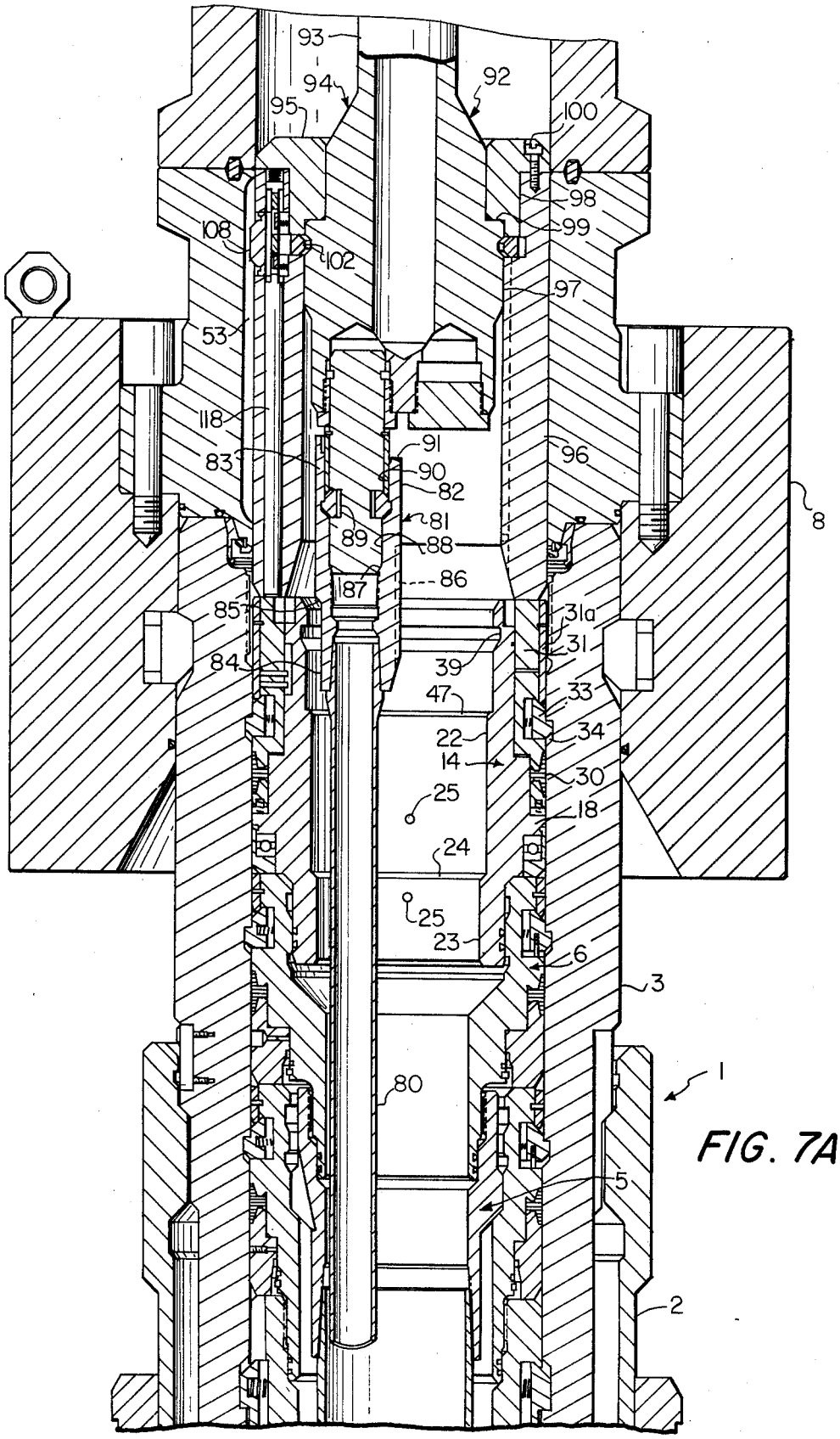
FIG. 7A is a view similar to FIG. 7, showing the parts after rotational orientation of the handling tool relative to the wellhead upper body has been accomplished.

To still segment 81 in hanger body 14, along with tubing string 80, handling string 93 is manipulated to run the combination of tool 92 and segment 81 down, typically down a riser or an extended casing, until the lower end of feeler rod 118 engages the upper end face of packer sleeve 31. Throughout the trip down, member 104 is maintained in its fully retracted position by portion 120 of the feeler rod, and ring 115 is therefore engaged both in groove 101 and in groove 102 so that body 94, carrying the segment 81, is locked to tubular body 96 in the position seen in FIG. 7. Once the tip of feeler rod 118 has engaged sleeve 31, further downward movement of tool 92 causes the combination of body 96 and member 104 to move downwardly relative to feeler rod 118, such movement continuing until the lower end face of body 96 seats on the upper end face of sleeve 31 as seen in FIG. 7A. At that point, ports 121 in portion 120 of the feeler rod register with bosses 112 and springs 116 are therefore free to urge member 104 outwardly. Initially, the action of springs 116 is only effective to force key 108 of member 104 into engagement with the wall of the bore of wellhead upper body 7, but the capability of further outward movement of member 104 persists because both the lower end of the feeler rod and the lower end of body 96 remain engaged with the upper end face of packer sleeve 31.

Handling string 93 is now manipulated to rotate tool 92 until key 108 registers with the locator groove 53 of body 7, member 104 then being moved outwardly by springs 116 to cause key 108 to snap into groove 53. Such outward movement of body 104 allows transfer member 114 to move outwardly, so that split ring 115 relaxes to its undistorted condition, expanding into groove 101 and fully out of engagement in groove 102. Such action frees body 94 for downward movement within body 96, but body 94 is restrained against rotation relative to body 96 because of engagement of pin 137 in groove 136. Handling string 93 is now lowered until shoulder 85 of segment 81 seats on shoulder 24 of hanger body 14. Since hanger body 14 was oriented by interaction of groove 53 and key 55, FIGS. 1 and 6, the rotational position of the hanger body relative to upper wellhead body 7 is predetermined, with orienting pins 25 thus occupying a known position. The location of bore 126 (and thus of hanger segment 81), groove 136, pin 137 and key 108 are such that grooves 86 in the hanger segment receive the orienting pins 25 as the segment approaches its fully landed position, and the segment is thus positively located in the intended 180° portion of the bore of hanger body 14, as shown in FIG. 11.

Segment 81 having been successfully landed, the segment is released from handling tool 92 by applying downward force on handling string 93 to force the combination of body 94 and thimble 129 to move downwardly relative to dowel 125. Such movement causes flange 130 of thimble 129 to force actuator sleeve 134 downwardly, so that pins 135 are sheared and the actuator sleeve is moved downwardly against camming surfaces 133 with the result that latch segments 132 are cammed to their retracted positions in groove 131. Tool 92 can now be withdrawn, leaving segment 81 seated on shoulder 24. Initial upward movement of handling string 93 causes shoulder 99 of body 94 to reengage member 95, the entire handling tool 92 then moving upwardly. As key 108 reaches the upper end of groove 53, member 104 is cammed inwardly so that bosses 112 are withdrawn from ports 121 and feeler rod 118 is thus freed to be moved downwardly through bore 117 by action of spring 119. Portion 120 of the feeler rod thus returns to its original position, engaging bosses 112 to hold member 104 retracted. Inward movement of member 104 moves transfer member 114 to force ring 115 again into engagement with groove 102 so that body 94 is locked to body 96.

Installation of Deflector Plug

Figure 13:
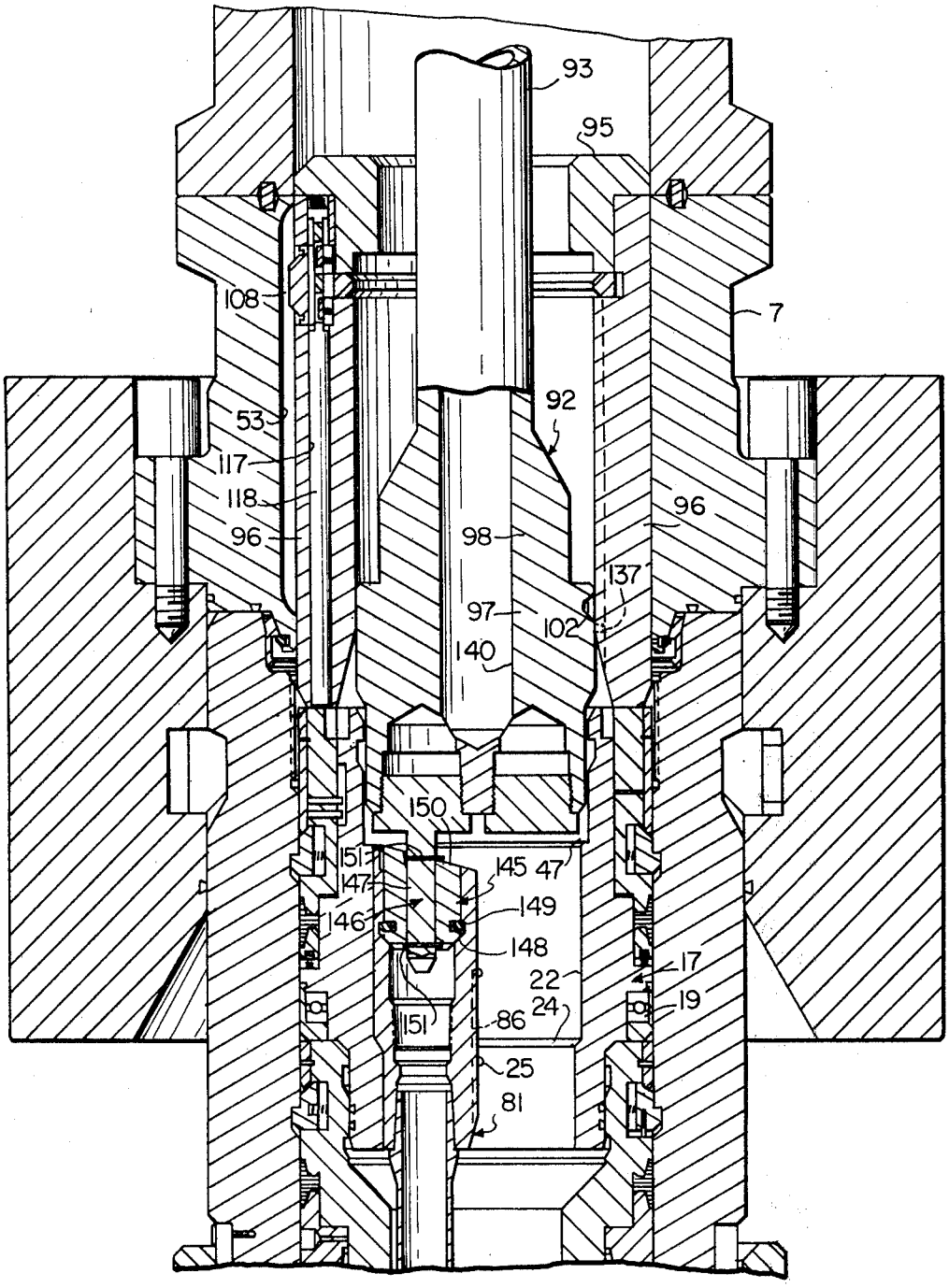
FIG. 13 is a view similar to FIG. 7 illustrating the landing of a deflector plug in the tubing hanger segment.

With the first segment 81 landed and the handling tool retrieved, the upper end of the segment is exposed to possible damage by the second segment to be landed. To protect segment 81, a deflector plug, indicated generally at 145, FIG. 13, is installed by use of the handling tool 92 previously employed to land hanger segment 81, dowel 125, FIG. 7. having been replaced with a deflector plug dowel 146. Deflector plug 145 has a cylindrical body 147 having a vertical through bore. The frustoconical lower end surface 148 is dimensioned to engage shoulder 87 of hanger segment 81. Body 147 carries a plurality of shearable pins 149 dimensioned to be received in groove 89 of the hanger segment, pins 149 being spring biased outwardly and constructed, for example, in accordance with U.S. Pat. No. 3,268,239 to Castor et al so that insertion of the deflector plug downwardly into segment 81 until the plug engages shoulder 87 causes pins 149 to snap into groove 89. The upper end face 150 of deflector plug 145 is slanted so that, when the deflector plug is properly oriented rotationally and inserted into segment 81, upper end face 150 of the deflector plug lies in the same plane as end face 91 of the hanger segment. Plug 145 is releasably retained on dowel 146 by shear pins 151.

Handling tool 92 functions, as described with reference to FIGS. 7–11, to orient the handling tool rotationally so that deflector plug 145 is aligned vertically with hanger segment 81 and to release body 94 to allow the deflector plug to be landed. Once the deflector plug has been secured in the hanger segment by action of shear pins 149, the handling tool is retrieved by applying an upward strain on handling string 93, pins 151 shearing to free dowel 146 from the deflector plug.

Installation of Second Tubing String

Figure 14:
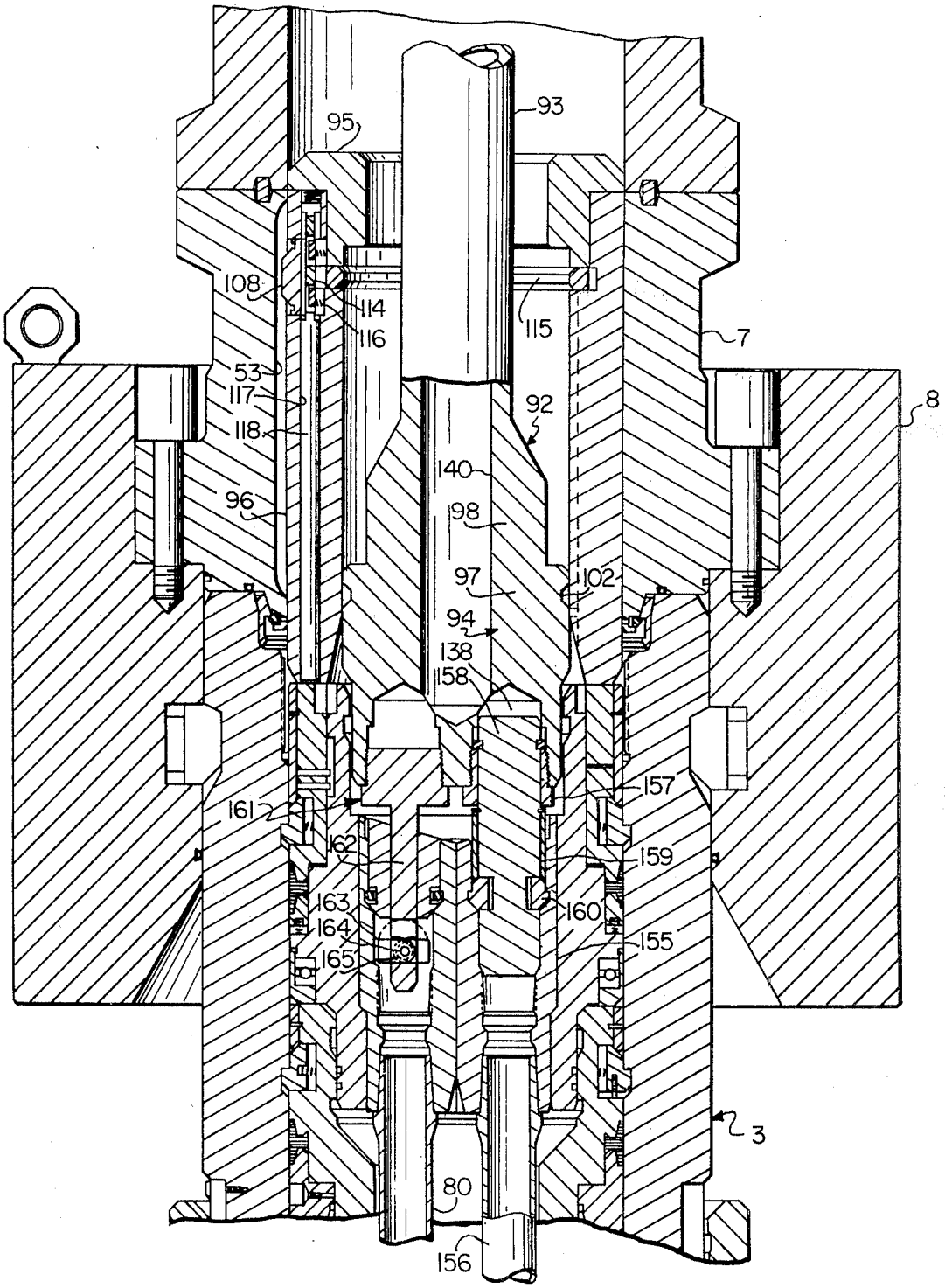
FIG. 14 is a view similar to FIG. 7 showing a landed second tubing hanger segment before removal of the handling tool.

As seen in FIG. 14, the hanger segment 155 from which the second tubing string 156 depends is also installed by means of handling tool 92 and handling string 93. For this purpose, plug 139, FIGS. 7 7A and 11, is replaced by a thimble 157 which retains a dowel 158 in bore 138. Dowel 158 is in all respects identical to dowel 125, FIGS. 7, 7A and 11, and serves to secure segment 155 to body 94 of handling tool 92 until, after segment 155 has been landed on shoulder 24 of hanger body 14, further downward movement of the handling string and handling tool forces sleeve 159 downwardly to cam latch segments 160 inwardly, disengaging the dowel from the segment. Manipulation of the handling tool to orient segment 155 in vertical alignment with its desired position in hanger body 14 is in all respcts the same as hereinbefore described with reference to installation of tubing string 80 and segment 81.

When hanger segment 155 is secured to the handling tool, dowel 125, FIG. 7, is replaced by a retrieving dowel 161, FIG. 14, which has an enlarged threaded upper end engaged in the threaded lower end portion of bore 126 in body 94. The dependent main body 162 of dowel 161 is dimensioned to be slidably accommodated by the through bore of deflector plug body 147. Orientation of the handling tool 92 by engagement of key 108 in groove 53 aligns dowel 161 vertically with the deflector plug so that, as hanger segment 155 is landed on shoulder 24, dowel 161 is inserted downwardly through the bore of body 147 of deflector plug 145. Dowel 161 is of such length as to pass completely through the deflector plug as the handling tool brings segment 155 into engagement with shouler 24. The lower end portion of body 162 of dowel 161 is slotted to accommodate two dogs 163 which are pivoted on a horizontal pin 164 and biased by a double ended torsion spring 165. As dowel body 162 enters the bore of the deflector plug, dogs 163 are pivoted upwardly to their retracted positions within the slot in body 162. When the lower end portion of body 162 passes below the deflector plug, spring 165 pivots dogs 163 downwardly into the laterally projecting positions seen in FIG. 14, the dogs being stopped in those positions by engagement with the bottom wall of the slot in body 162.

After latch segments 160 have been disengaged to free dowel 158 from segment 155, upward movement of handling string 93 and handling tool 92 causes dogs 163 to engage the lower end of deflector plug 145 and continued upward strain on the handling string results in shearing of pins 149 so that deflector plug 145 is retrieved with the handling tool.

Installing Tubing Hanger Packoff Device

Figure 15:
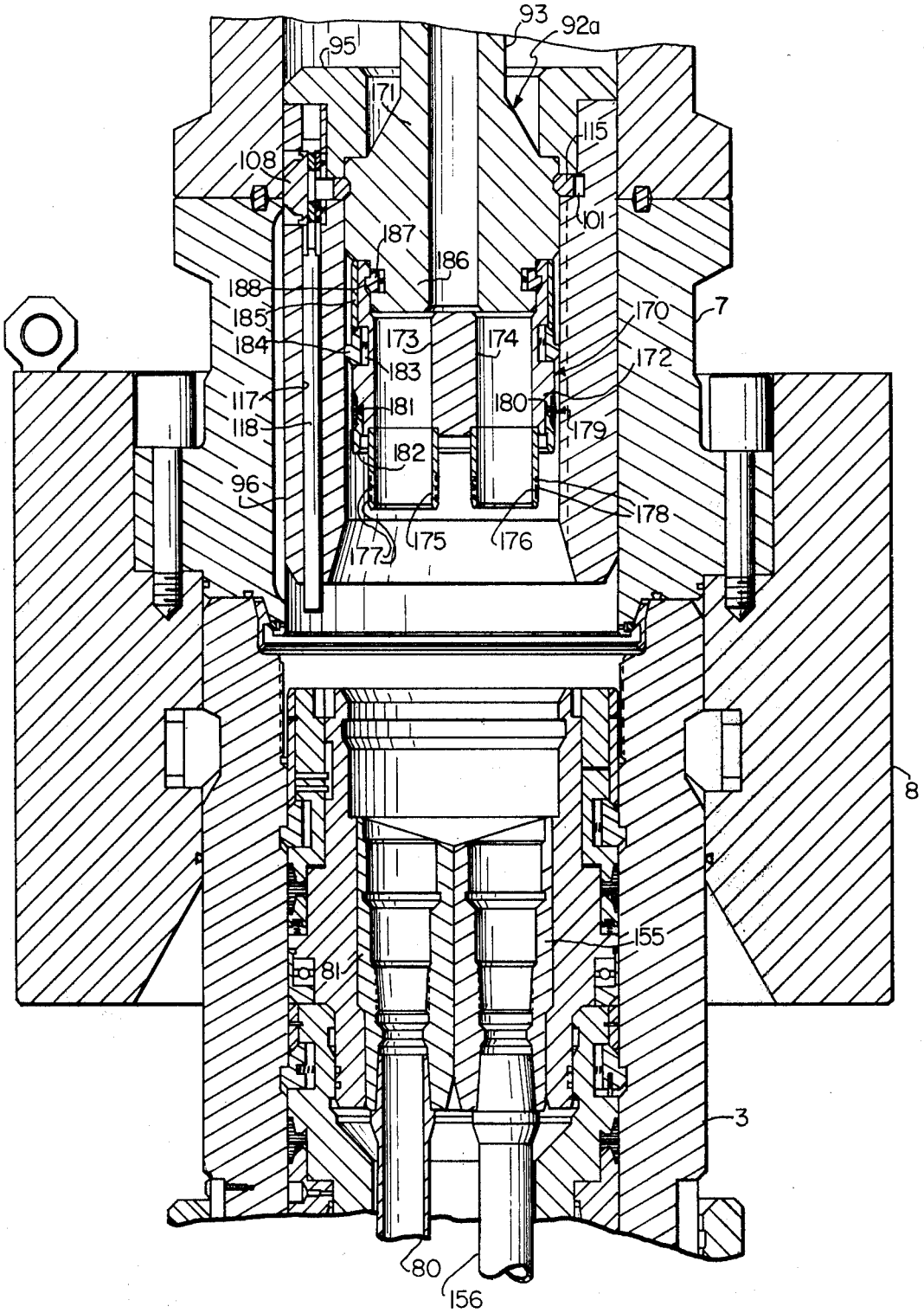
FIGS. 15 and 15A are views similar to FIGS. 7 and 11, respectively, illustrating installation of a tubing hanger packoff device according to the invention.
Figure 15A:
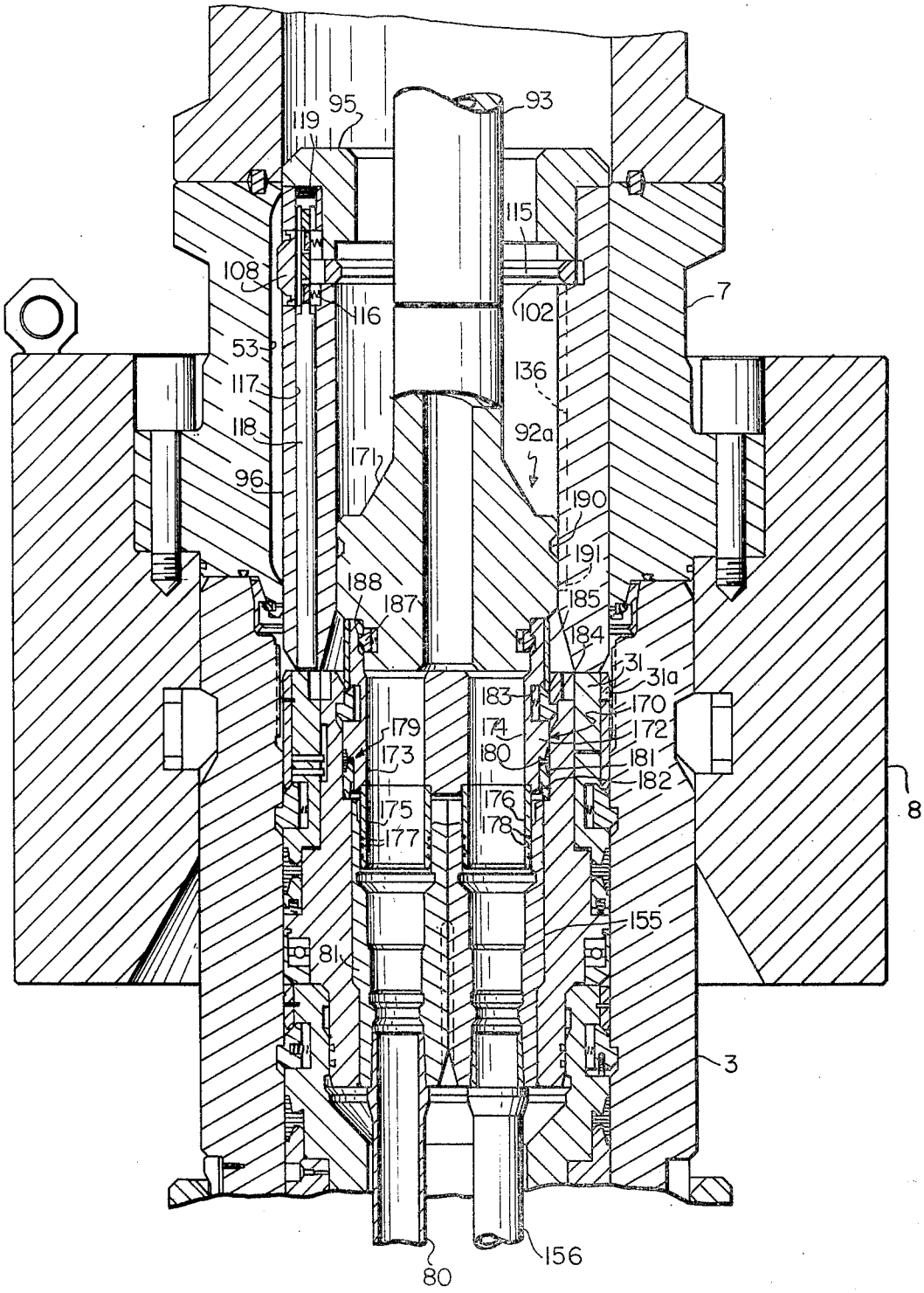

FIG. 15 illustrates installation of a tubing hanger packoff device 170 according to the invention, installation being accomplished with a handling tool **92*a* which is secured to handling string 93 and includes all of the elements of handling tool 92, FIGS. 7, 7A and 11, except main body 94, that element being replaced by a main tool body 171, FIG. 15. Packoff device 170 comprises a main body 172 having two vertical through bores 173, 174 which are spaced apart diametrically of body 172 so that, in one rotational position of body 172 in wellhead upper body 7, bore 173 will be aligned vertically above segment 81 and bore 174 will be aligned vertically above segment 155. Bores 173 and 174 are enlarged at their lower ends to accommodate the upper end portions of sleeves 175 and 176, respectively, those sleeves being welded to body 172. Sleeve 175 is dimensioned to be received within the upper end portion of segment 81 and is provided with O-rings 177 to seal between sleeve 175 and inner wall portion 90 of segment 81. Sleeve 176 is similarly dimensioned to be accommodated by the upper end portion of segments 155 and is provided with O-rings 178** to seal with that segment.

Body 172 carries an external seal device, indicated generally at 179, constructed generally according to U.S. Pat. No. 3,268,241 to Castor et al. At the lower end portion of body 172, the outer diameter of the body is reduced, presenting a downwardly facing shoulder at 180. An elastomeric seal ring 181 embraces body 172 below shoulder 180, and a rigid actuating ring 182 slidably embraces body 172 below seal ring 181. Actuating ring 182 is initially secured to body 172, as by shear pins (not shown) in a position such that ring 182 projects well beyond the lower end of body 172. Above shoulder 180, body 172 has an outwardly opening transverse annular groove 183 which accommodates a plurality of latching segments 184 biased outwardly by springs (not shown) segments 184 being constructed according to the aforementioned Bickel et al U.S. Pat. No. 3,171,647. Above groove 183, body 172 is equipped with an actuating sleeve 185 which engages the upwardly directed cam faces of segments 184 to hold the segments in radial positions such that the outer tips of the segments bear lightly on the inner surface of tubular body 96 of the handling tool.

Main tool body 171 has a lower end portion 186 of a diameter such as to be slidably received in the upper end portion of body 172 of the packoff device. Portion 186 carries a plurality of shear pins 187 which are constructed according to the aforementioned Castor et al U.S. Pat. No. 3,268,239, being spring-biased outwardly into engagement with a transverse annular inwardly opening groove 188 in body 172. Above portion 186, body 171 is of a diameter to be slidably embraced by the inner wall of tubular body 96, a downwardly facing shoulder 189 being provided which is in engagement both with the upper end face of body 172 and the upper end of actuating sleeve 185. The remainder of body 171 is identical with body 94, FIG. 7, and presents a transverse annular outwardly opening groove 190 corresponding to groove 102, FIGS. 7 and 8, and operative to receive split ring 115 to secure body 171 releasably to tubular body 96. Immediately below groove 190, body 171 is equipped with a radially projecting locator pin 191 engaged in groove 136 of member 96, pin 191 corresponding to pin 137, FIG. 7, and being so positioned on body 171 that, when key 108 is engaged in groove 53, sleeves 175 and 176 are axially aligned respectively with segments 81 and 155.

Packoff device 170 is installed by manipulating handling string 93 to move the combination of handling tool **92*a* and the packoff device downwardly until the lower end of body 96 engages sleeve 31, the handling string then being rotated until key 108 snaps into groove 53, at which point tool body 171 is freed from body 96 so that further descent of the handling string causes sleeves 175 and 176 to enter hanger segments 81 and 155, respectively, with actuating ring 182 coming into engagement with shoulder 47 of hanger body 17 well before the sleeves are fully inserted in the segments. Continued downward movement of tool body 171 and packoff device 170 causes seal ring 181 to be compressively engaged between actuating ring 182 and shoulder 180, with the webs of the seal ring being forced outwardly to seal against the surrounding wall presented by body 17. As packoff device 170 moves into the upper end portion of hanger body 17, latch segments 184 are cammed inwardly by the chamfer at the inner periphery of the upper end face of body 17. At a point when seal ring 181 has been fully energized, segments 184 snap outwardly into groove 39 to latch packoff device 170 securely to body 17 of the hanger and thus hold seal ring 181 in its energized condition. With the packoff device thus latched in place, sleeves 175 and 176 are in proper positions within the upper end portions of hanger segments 81 and 155, respectively. An upward strain on handling string 93 will now cause pins 187 to shear so that tool body 171 can move upwardly within body 96 into engagement with body 95, and tool 92*a*** can then be retrieved.

Packoff device 170 can be retrieved by use of any suitable tool equipped with latching dogs to engage in groove 188 when the tool is landed and so constructed that a part of the tool forces actuating sleeve 185 downwardly to retract segments 184 and thus free the packoff device from the hanger body.

Installation of Circulation Tool

Figure 16:
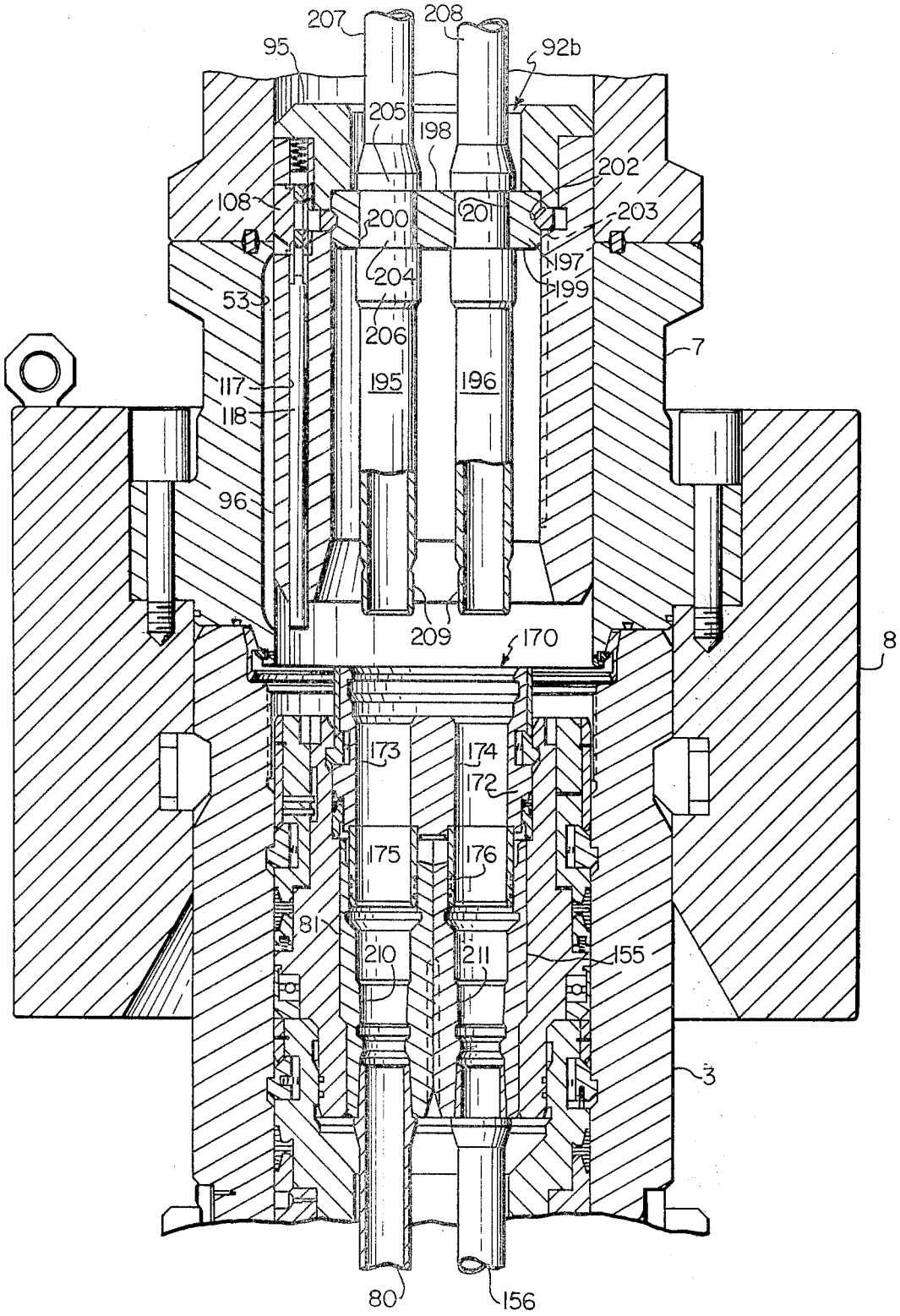
FIGS. 16 and 16A are views similar to FIGS. 7 and 11, respectively, illustrating installation of circulation stingers according to the invention.

With hanger segments 81, 155 in place and packoff device 170 installed, it is now necessary to establish communication between each tubing string 80, 156 and the vessel or platform so that fluid can be circulated through the tubing strings and tubing plugs can be installed. This is accomplished by employing handling tool **92*b* to run in tubular stingers 195 and 196 in the manner illustrated in FIGS. 16 and 16A**.

Tool **92*b* again employs all of the components of tool 92, FIG. 7, except for main body 94 which is replaced by a circular main tool body 197. Body 197 is circular and has flat top and bottom faces 198 and 199 and two vertical through bores 200 and 201, the through bores being spaced apart diametrically of the body by a distance and in positions such that, when body 197 is properly oriented rotationally in body 96, and body 96 is oriented by engagement of key 108 in groove 53, bores 200 and 201 will be coaxially aligned with hanger segments 81 and 155, respectively. Body 197 has a transverse annular outwardly opening groove 202 which corresponds to groove 102, FIG. 7, and accommodates split ring 115 to secure body 197 releasably to body 96. Orientation of body 197 within body 96 is accomplished by providing body 197 with a locator pin 203 which projects radially from the body and is engaged in groove 136**.

Figure 16A:
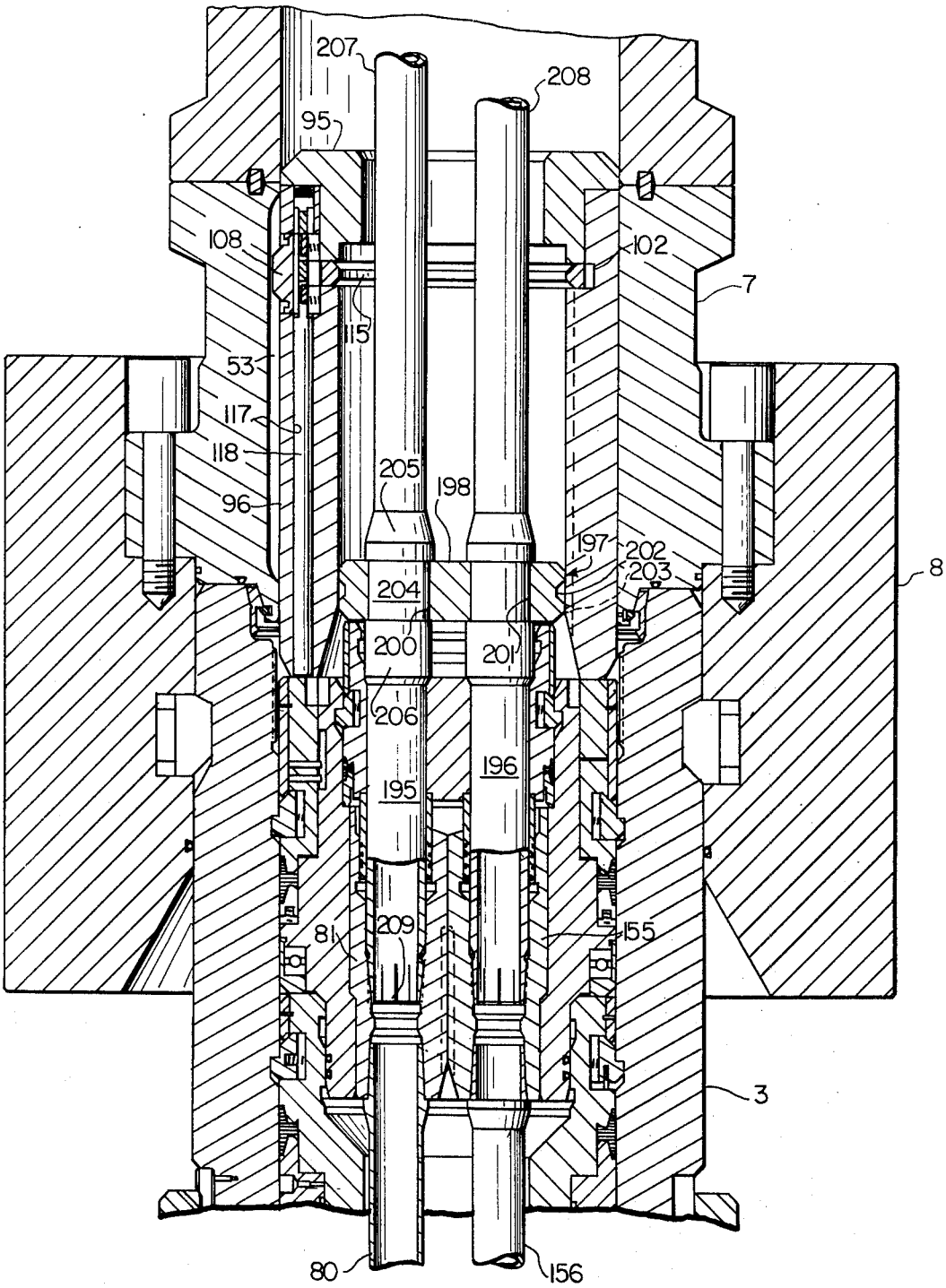

Stingers 195 and 196 are identical, each comprising an intermediate portion 204 having a right cylindrical outer surface slidably embraced by the wall of the respective bore 200, 201. Enlargements 205 and 206 are provided respectively above and below body 197 to present shoulders to engage faces 198, 199. The upper end of each stinger 195, 196 is connected to a different one of two tubing strings 207 and 208 which together serve as the handling string for tool **92*b* and which communicate independently with the two stingers. The lower tip portions 209 of each stinger are slotted longitudinally and provided with conventional external "stab threads" to lock into internally threaded portions of hanger segments 81 and 155 at 210 and 211, respectively, when the stingers are fully inserted in the hanger segments as seen in FIG. 16A, such thread engagement preventing the stingers from backing out of the segments when pressure is applied to the tubing strings via tubing 207, 208**.

Operation of tool **92*b* during installation of stingers 195, 196 is generally the same as hereinbefore described with reference to tools 92 and 92*a*. When tool 92*b* and stingers 195, 196 are to be retrieved, each handling string 207, 208 is rotated to release the threaded tip portions of stingers 195, 196 from the respective hanger segments 81, 155 and the handling strings are then pulled to remove tool 92*b*** with the stingers still secured to the tool.

Installation of Christmas Tree

Figure 17:
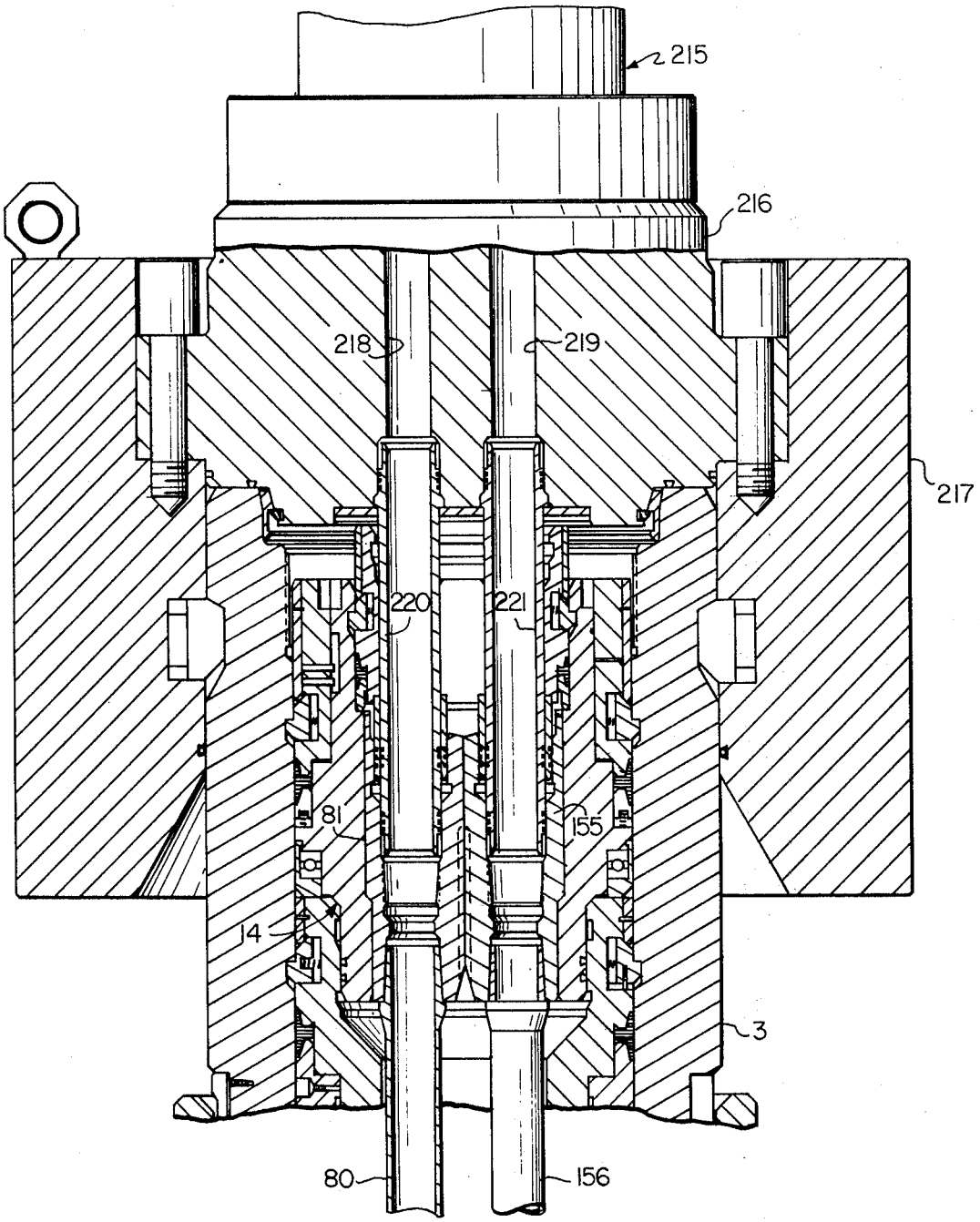
FIG. 17 is a view similar to FIG. 7 showing a Christmas tree installed to complete the well installation.

After tool **92*b* and stingers 195, 196 have been retrieved, the riser is removed, connector 8 is operated to release from body 3, and the combination of connector 8 and wellhead upper body 7 is removed. The well is then completed by installing a conventional Christmas tree assembly indicated generally at 215, FIG. 17. The tree assembly includes a production upper body 216 equipped with a conventional remotely operated connector 217 for securing body 216 to body 3**. The tree assembly is equipped with guide arms (not shown)

which cooperate with the guide posts of the primary guide system (not shown), so that the tree assembly when landed occupies a known rotational position relative to the guide posts and, therefore, relative to hanger segments 81, 155.

Body 216 has two through bores 218, 219 to communicate respectively with tubing strings 80 and 156 via hanger segments 81, 155. Body 216 is equipped with two dependent tubular stingers 220 and 221 each communicating with a different one of bores 218, 219. Stingers 220 and 221 are so disposed on body 216 that when body 216 has been oriented by the guide system, movement of the body downwardly into engagement with body 3 causes stingers 220 and 221 first to stab through bores 173 and 174, respectively, of packoff device 170 and then into hanger segments 81 and 155.

DETAILED DESCRIPTION OF THE METHOD

From the foregoing description of the apparatus embodiments, it is apparent that groove 53, FIG. 1, constitutes a rotational orientation reference, the location of that groove having been determined because the combination of body 7 and connector 8 are precisely positioned by the guide posts at the wellhead. Hanger body 14 is installed in a rotational position predetermined by coaction of key 55 and groove 53, and the locator pins 25, which determine the positions to be occupied by tubing hanger segments 81 and 155, are therefore disposed in predetermined positions relative to groove 53.

With the first tubing hanger segment 81 secured to the main body 94 of the handling tool in the position determined by bore 126, FIG. 7, the main body of the tool is releasably secured to the tubular member 96 of the handling tool by engagement of ring 115 in groove 102, the rotational position of body 94 relative to key 108 being fixed by engagement of pin 137 in groove 136. At this stage, feeler rod 118 projects below the lower end of body 96. Handling string 93 is now manipulated to lower the handling tool until the lower end of body 96 engages sleeve 31, with the result that rod 118 is forced to its uppermost position and key body 104 is therefore released so as to be capable of moving outwardly under the force applied by springs 116. The handling string is now rotated until key 108 snaps outwardly into groove 53. Such coaction of the key and groove causes segment 81 to be aligned coaxially with its respective portion of the bore of of hanger body 14 and also causes ring 115 to disengage from groove 102, releasing body 94 from body 96. The handling string is then manipulated to lower body 94 and hanger segment 81 until the hanger segment lands in its predetermined rotational position on shoulder 24 of the hanger body. During this step, locator pin 137 remains engaged in groove 136 and, of course, key 108 remains engaged in groove 53, so that proper orientation of body 94 and segment 81 is preserved until the segment is landed. As the segment approaches shoulder 24, locator pins 25 engage in the half-grooves or flutes 86 of the segment to finalize location of the segment.

A final increment of downward movement of the handling string and body 94 is then effective to force actuator sleeve 134 downwardly within segment 81 to force segments 132 inwardly, releasing dowel 125 from the segment, and the combination of the handling string and body 94 is pulled until body 94 engages body 95. Further withdrawal of the handling string raises the entire handling tool, so that key 108 reaches the upper end of groove 53 and is cammed inwardly, causing bosses 112 to be withdrawn from ports 121, FIG. 10, to free feeler rod 118 to be moved downwardly relative to body 96 by spring 119. Such downward movement of the feeler rod locks member 104 in its retracted position and locks ring 115 again in groove 102, so that body 94 is again secured to body 96. The entire handling tool is now retrieved by pulling the handling string.

With the handling tool again at the vessel or platform, dowel 125 is replaced by dowel 146, FIG. 13, carrying the deflector plug 145, and the method repeated for installation of the deflector plug in hanger segment 81. The handling tool is then retrieved and used again to install the second hanger segment 155 and tubing string 156, after which the handling tool is again retrieved. Body 94 is then replaced by body 171, FIG. 15, the method is repeated for installation of the tubing hanger packoff device 170, and the handling tool again recovered. Body 171 is then replaced by body 197, FIG. 16, and the method is repeated, using tubing strings 207 and 208 as the handling string, for installation and ultimate retrieval of circulation stingers 195 and 196. After retrieval of the handling tool and stingers 195, 196, the Christmas tree is installed conventionally.

What is claimed is:

1. In the completion of a mutiple string underwater well installation of the type comprising a generally tubular support structure located under water above the well bore and including rotational orientation reference means, the improvement comprising installing in the tubular support structure a multiple string tubing hanger body constructed and arranged to support at least two tubing hanger segments each occupying a predetermined position witin the hanger body, said step of installing the hanger body being carried out in a manner which locates the hanger body in a predetermined rotational position relative to the rotational orientation reference means;

providing a handling tool having a main body connected to a handling string, a tubular body surrounding the main body and extending therebelow, and locator means carried by the tubular body and operative to coact with the orientation reference means of the support structure;

releasably securing the main body of the handling tool to the tubular body of the handling tool in the same rotational orientation relative to the locator means of the handling tool as the hanger body occupies relative to the orientation reference means;

releasably securing the hanger segment of a first tubing string to the main body of the handling tool;

manipulating the handling string to lower the handling tool and the first tubing string under the locator means of the handling tool is in a position to coact with the orientation reference means;

rotating the handling string to rotate the handling tool until the locator means coacts with the orientation reference means;

releasing the main body of the handling tool from the tubular body of the handling tool;

lowering the main body of the handling tool through the tubular body of the handling tool, while preventing rotation of the main body relative to the tubular body, until the hanger segment of the first tubing string has landed in the hanger body;

releasing the main body of the handling tool from the hanger segment of the first tubing string;

retrieving the handling tool;

again releasably securing the main body of the handling tool to the tubular body of the handling tool in said same rotational orientation;

releasably securing the hanger segment of a second tubing string to the main body of the handling tool;

again lowering the handling tool an again rotating the handling tool until the locator means coacts with the orientation reference means;

again releasing the main body of the handling tool from the tubular body of the handling tool and lowering the main body through the tubular body, while preventing rotation of the main body relative to the tubular body, until the hanger segment of the second tubing string has landed in the hanger body;

releasing the hanger segment of the second tubing string from the main body of the handling tool; and retrieving the handling tool.

2. The method according to claim 1, further comprising connecting to the main body of the handling tool, after retrieving the handling tool following installation of the first tubing string, a deflector plug constructed and arranged for installation in the hanger segment of the first tubing string, the deflector plug being connected to the main body of the handling tool in the same position which was occupied by the hanger segment of the first tubing string;

manipulating the handling string to lower the handling tool and deflector plug until the locator means of the handling tool is in a position to coact with the orientation reference means;

rotating the handling string to rotate the handling tool until the locator means coacts with the orientation reference means;

releasing the main body of the handling tool from the tubular body of the handling tool;

lowering the main body of the handling tool through the tubular body of the handling tool, while preventing rotation of the main body relative to the tubular body, until the deflector plug has landed in the hanger segment of the first tubing string;

releasing the main body of the handling tool from the deflector plug; and retrieving the handling tool and then installing the hanger segment of the second tubing string by carrying out the steps recited in claim 1.

3. The method according to claim 2, further comprising reconnecting the deflector plug to the main body of the handling tool simultaneously with landing of the hanger segment for the second tubing string; and retrieving the deflector plug with the handling tool when the handling tool is next retrieved.

4. The method according to claim 1, further comprising providing a tubing hanger packoff device including a body having two through bores to communicate respectively with the hanger segments of the first and second tubing strings when the packoff device has been installed in the tubular support structure;

replacing the main body of the handling tool with a second main body adapted to be releasably connected to the packoff device;

connecting the packoff device to the second main body and releasably connecting the second main body to the tubular body of the handling tool in the same rotational orientation relative to the locator means of the handling tool as the hanger body occupies relative to the orientation reference means;

manipulating the handling string to lower the handling tool and packoff device until the locator means is in a position to coact with the orientation reference means;

rotating the handling string to rotate the handling tool until the locator means coacts with the orientation reference means;

releasing the second main body of the handling tool from the tubular body of the handling tool;

lowering the second main body of the handling tool through the tubular body of the handling tool, while preventing rotation of the second main body relative to the tubular body, until the packoff device has been landed;

releasing the handling tool from the packoff device; and retrieving the handling tool.

5. The method according to claim 4, further comprising replacing the second main body of the handling tool with a third main body having two through bores spaced apart by the same distance as the hanger segments of the first and second tubing string are spaced in the hanger body;

removing the handling string;

installing two tubular stingers each in a different one of the through bores of the third main body;

connecting the upper ends of the stingers each to a different one of two handling tubing strings;

releasably connecting the third main body of the handling tool to the tubular body of the handling tool in the same rotational orientation relative to the locator means of the handling tool as the hanger body occupies relative to the orientation reference means;

manipulating the two handling tubing strings to lower the handling tool and stingers until the locator means is in a position to coact with the orientation reference means;

rotating the handling tool, by manipulating the two handling tubing strings, until the locator means of the handling tool coacts with the orientation reference means;

releasing the third main body of the handling tool from the tubular body of the handling tool;

lowering the third main body of the handling tool through the tubular body of the handling tool, while preventing rotation of the third main body relative to the tubular body, until the stingers have been inserted into operative positions in the hanger segments;

carrying out operations in the well bore by circulating fluid through the handling tubing strings and the stingers; and retrieving the handling tool and stingers.

6. The method for remotely installing multiple tubing strings independently in an underwater well installation, comprising establishing in an underwater location above the well bore a tubular support structure including a tubing hanger body and rotational orientation means located above the tubing hanger with the tubing hanger body defining specific locations for at least two tubing hanger segments and occupying a predetermined rotational position relative to the rotational orientation means;

connecting a handling tool main body to a handling string at an operational base above the underwater location;

releasably connecting the handling tool main body to a handling tool tubular body equipped with locator means constructed and arranged to coact with the rotational orientation means;

releasably connecting the hanger segment of a first tubing string to the handling tool main body with the hanger segment depending from the handling tool main body in a position such that rotation of the handling tool can bring the hanger segment into vertical alignment above its intended specific location in the tubing hanger body;

manipulating the handling string to lower the handling tool to a position in which the hanger segment is above the hanger body and the locator means can coact with the rotational orientation means;

manipulating the handling string to rotate the combination of the handling tool and the hanger segment until the locator means coacts with the rotational orientation means;

releasing the handling tool main body from the handling tool tubular body in response to coaction of the locator means with the rotational orientation means;

lowering the handling tool main body through the handling tool tubular body, while preventing rotation of the main body relative to the tubular body, and thereby landing the hanger segment in its intended specific location in the hanger body;

releasing the hanger segment from the handling tool; and retrieving the handling tool preparatory to using the handling tool to install the hanger segment for the second tubing string.

7. In a handling tool for remotely installing a device with specific rotational orientation in an underwater well installation of the type having a tubular support structure located under water and provided with rotational orientation reference means disposed above the location at which the device being installed is to be landed, the combination of a main body adapted to be connected to at least one handling string in such manner that the at least one handling string can be manipulated to rotate the main body about its central axis, the main body having a circular outer surface, and means for connecting to the main body at least one device to be installed, with the connected device depending from the main body;

a tubular body surrounding the main body and equipped with externally exposed locator means constructed and arranged to coact with the rotational orientation reference means of the underwater tubular support means;

releasable means for securing the main body to the tubular body, the main body being free to be moved downwardly through the tubular body when the releasable means has been released; and locator means coacting between the main body and the tubular body for maintaining the main body in a predetermined rotational position relative to the externally exposed locator means when the main body is secured to the tubular member and while the main body is moved through the tubular member.

8. The combination defined in claim 7, wherein the releasable means is constructed and arranged to release the main body for downward movement through the tubular body in response to coaction of the externally exposed locator means with the rotational orientation reference means.

9. The combination defined in claim 8, wherein the rotational orientation reference means is a vertical inwardly opening groove;

the externally exposed locator means is a key carried by the tubular member for movement between a recessed position and an outwardly projecting position, the key being resiliently biased outwardly to snap into the vertical groove when rotation of the handling tool causes the key to register with the groove; and the releasable means comprises an outwardly opening recess in the main body, a retaining member carried by the tubular body and normally occupying an outwardly displaced inactive position, and means operated by the key for forcing the retaining member into the recess when the key is in its recessed position.

10. The combination defined in claim 9, wherein the outwardly opening recess in the main body is a transverse annular groove; and the retaining member is a resilient split ring disposed in an inwardly opening transverse annular groove in the tubular member, the split ring being contracted into engagement in the outwardly opening groove as a result of movement of the key inwardly to its recessed position.

11. The combination defined in claim 9, wherein the lower end of the tubular member is dimensioned to engage a predetermined element in the tubular support structure and thus limit downward movement of the tubular member;

the combination further comprising a vertical feeler rod carried by the tubular element and movable between a first position, in which the feeler rod extends below the lower end of the tubular member, and a second position, in which the feeler rod is displaced upwardly from its first position; and means operated by the feeler rod for locking the key in its recessed position when the feeler rod is in its first position and releasing the key for outward movement only when the feeler rod is in its second position.

12. The combination defined in claim 7, wherein the locator means coacting between the main body and the tubular body comprises a vertical groove on one of the bodies, and a locator member carried by the other of the bodies and projecting into the vertical groove.

13. The combination defined in claim 7, wherein the main body has a downwardly opening bore located in the lower end thereof and spaced from the central axis of the main body by a distance equal to that by which the device to be installed is to be spaced from the central axis of the tubular support structure when the device is properly landed; and the means for connecting at least one device to be installed comprises a dowel retained in the downwardly opening bore and depending from the main body, and means carried by the dowel for releasably securing the device to be installed to the dowel.

14. The combination defined in claim 13, wherein the device to be installed is the tubing hanger segment of a first tubing string, the segment having a through bore and a transverse annular inwardly opening groove;

the dowel carries a plurality of latching segments mounted for movement between a recessed position and an outwardly projecting latching position, the latching segments being resiliently biased outwardly, disposed to engage in the inwardly opening groove of the hanger segment when the dowel is inserted into the hanger segment, and provided with upwardly directed camming surfaces which are exposed at the periphery of the dowel when the segments are in their latching position;

a segment retracting sleeve slidably embraces the dowel between the segments and the main body; and the main body can be moved downwardly relative to the dowel to cause the segment retracting sleeve to move downwardly against the camming surfaces of the latching segments to retract the latching segments and thus release the hanger segment from the dowel after the hanger segment has been landed in the hanger body.

15. The combination defined in claim 13, wherein the main body has a second downwardly opening bore spaced from the central axis of the main body by a distance equal to that by which a second device to be installed is to be spaced from the central axis of the tubular support structure when the second device is properly landed, whereby the handling tool can be employed for installing both the first and second device.

16. The combination defined in claim 15, wherein both of said downwardly opening bores are of the same diameter and each is internally threaded;

an externally threaded thimble is engaged in said first mentioned bore, said thimble being shorter than the bore in which it is engaged, said dowel being slidably embraced by said thimble and extending thereabove, the upper end portion of said dowel having a transverse enlargement engaged over the upper end of the thimble to retain the dowel.

* * * * *